US005126943A

United States Patent [19]

Nakaniwa

[11] Patent Number: 5,126,943

[45] Date of Patent: Jun. 30, 1992

[54] LEARNING-CORRECTING METHOD AND APPARATUS AND SELF-DIAGNOSIS METHOD AND APPARATUS IN FUEL SUPPLY CONTROL SYSTEM OF INTERNAL COMBUSTION ENGINE

[75] Inventor: Shinpei Nakaniwa, Isesaki, Japan

[73] Assignee: Japan Electric Control Systems Co., Ltd., Isesaki, Japan

[21] Appl. No.: 540,008

[22] Filed: Jun. 19, 1990

[30] Foreign Application Priority Data

Jun. 19, 1989 [JP] Japan ..... 1-154440

[51] Int. Cl.[5] ..... F02M 51/00

[52] U.S. Cl. ..... 364/431.05; 123/673; 123/690

[58] Field of Search ..... 364/431.01, 431.05, 364/431.11; 123/440, 489, 492, 478

[56] References Cited

U.S. PATENT DOCUMENTS

| | | | |
|---|---|---|---|
| 4,483,300 | 11/1984 | Hosaka et al. | 123/489 |
| 4,627,402 | 12/1986 | Saito et al. | 123/489 X |
| 4,922,429 | 5/1990 | Nakajima et al. | 364/431.05 X |
| 4,962,741 | 10/1990 | Cook et al. | 123/489 |
| 4,991,102 | 2/1991 | Sakamoto et al. | 364/431.05 X |

*Primary Examiner*—Parshotam S. Lall
*Assistant Examiner*—E. J. Pipala
*Attorney, Agent, or Firm*—Foley & Lardner

[57] ABSTRACT

In a fuel supply control system of an internal combustion engine having a function of feedback-controlling the air-fuel ratio, dispersions of the fuel supply characteristics in respective cylinders are corrected by changes of the air-fuel ratio by the correction of the fuel supply quantity. Factors causing the deviations of the air-fuel ratio are independently compensated by learning the correction value for correcting the fuel supply quantity only at a certain ratio and the correction value for correcting the fuel supply quantity only by a certain quantity so that these correction values are commonly fit for at least two different driving conditions.

8 Claims, 17 Drawing Sheets

LEARNING-CORRECTING METHOD AND APPARATUS AND SELF-DIAGNOSIS METHOD AND APPARATUS IN FUEL SUPPLY CONTROL SYSTEM OF INTERNAL COMBUSTION ENGINE

BACKGROUND OF THE INVENTION (1) Field of the Invention

The present invention relates to a learning-correcting method and apparatus and a self-diagnosis method and apparatus in a fuel supply control system of an internal combustion engine. More particularly, the present invention relates to a learning-correcting method and apparatus for correcting deviations of an air-fuel ratio by respective factors in a fuel supply control system provided with a function of the feedback control of the air-fuel ratio and a self-diagnosis method and apparatus for diagnosing disorder of the fuel supplys control system based on the results of this correction by the respective factors.

(2) Description of the Related Art

As the known fuel supply control system of an internal combustion engine, the following system can be mentioned.

A sucked air flow quantity Q is detected as the quantity of the state of sucked air, and based on sucked air detected values and the detected value of the engine revolutions N, the basic fuel supply quantity Tp is computed. Then, this basic fuel supply quantity Tp is corrected, based on various correction coefficients COEF set by various driving state factors, such as the engine temperature represented by the cooling water temperature, an air-fuel ratio feedback correction coefficient LMD set based on the air-fuel ratio in the air-fuel mixture detected through the oxygen concentration in the exhaust gas and a correction proportion Ts for correcting the change of the opening or closing delay of the fuel injection valve by the battery voltage, to compute a final fuel supply quantity ($=Tp \times COEF \times LMD \times Ts$). Fuel in this computed quantity is supplied to the engine through a fuel injection valve or the like (see Japanese Unexamined Patent Publication No. 60-240840).

The air-fuel ratio feedback correction coefficient LMD is set, for example, by proportional-integral control. When the actual air-fuel ratio detected, based on the oxygen concentration in the exhaust gas detected by an oxygen sensor, is rich (lean) as compared with the target air-fuel ratio (theoretical air-fuel ratio), the air-fuel ratio feedback correction coefficient LMD is first decreased (increased) by a proportion component P and then gradually decreased (increased) by and integration component I synchronously with the revolution of the engine or at the same frequency as that of the revolution of the engine. Thus, the actual air-fuel ratio is controlled in such a manner that reversal of the actual air-fuel ratio is repeated in the vicinity of the target air-fuel ratio.

In the above-mentioned fuel supply control system, when a deviation of the air-fuel ratio is caused, this deviation is detected by the oxygen sensor and the air-fuel ratio is feedback-controlled to the target air-fuel ratio. Accordingly, generation of the deviation of the air-fuel ratio can be judged by the feedback correction coefficient. However, since there are many factors causing the deviation of the air-fuel ratio, it is impossible to judge the factor actually causing the deviation of the air-fuel ratio.

As factors, causing the deviation of the air-fuel ratio, the leakage of air to the downstream side of the air flow meter for measuring the sucked air quantity, the deviation of the injection characteristics of the fuel injection valve and disorders of the pressure regulator for determining the pressure of the supplied fuel and the fuel pump can be mentioned. Patterns of the deviations of the air-fuel ratio caused by these factors are different from one another.

Accordingly, for example, even if the air-fuel ratio feedback correction coefficient LMD is learned for each of driving conditions classified by the engine load and revolution speed and a learning correction coefficient for each driving condition is set to correct the fuel supply quantity so that the air-fuel ratio obtained without the air-fuel ratio feedback correction coefficient LMD is brought close to the target air-fuel ratio, since the oxygen sensor generally detects the average air-fuel ratio in respective cylinders, especially if deviations of the injection characteristics are caused among the respective cylinders, it is impossible to obtain the target air-fuel ratio in any of the cylinders. Furthermore, since patterns of deviations of the air-fuel ratio for respective driving conditions by the factors are different from one another, attainment of a good correction cannot be expected in a driving condition where the learning frequency is low, and it is apprehended that a great gap of the air-fuel ratio is brought about by the difference of the learning frequency.

SUMMARY OF THE INVENTION

The present invention has been developed under the above-mentioned background. It is an object of the present invention to provide a learning-correcting method and apparatus in which, even in the case where deviations of the air-fuel ratio are caused by a plurality of factors, generation of a large gap of the air-fuel ratio by the difference of the learning frequency or driving condition can be avoided and the target air-fuel ratio can be obtained in respective cylinders, and a self-diagnosis method and apparatus in which the self-diagnosis of the deviation of the air-fuel ratio by factors can be performed based on such learning results.

In accordance with the present invention, this object can be attained by a learning-correcting method in a fuel supply control system of an internal combustion engine, which system is constructed so that the fuel supply quantity is feedback-controlled based on a detected value of the air-fuel ratio to bring the detected value of the air-fuel ratio close to the target air-fuel ratio and the fuel is independently supplied to respective cyclinders by fuel supply means disposed for the respective cylinders, said method comprising forcibly correcting the fuel supply quantity independently for the respective cylinders, setting correction values for the respective cylinders, which are used for correcting the fuel supply quantity independently for the respective cylinders based on the difference between an expected value of the change of the air-fuel ratio, obtained by said forcible correction, and the actually detected value of the change of the air-fuel ratio, and learning a first correction value for correcting the detected value of the sucked air flow quantity only by a certain quantity and a second correction value for correcting the fuel supply quantity only at a certain ratio, so that said two correction values are commonly fit for at least two different driving conditions so as to make the air-fuel ratio obtained without said feedback control, substantially equal to the target air-fuel ratio.

More specifically, by forcibly correcting the fuel supply quantity and detecting the change of the air-fuel ratio, it becomes possible to judge whether or not the fuel is actually supplied in an amount corresponding to the correction, whereby correction values for respective cylinders, which are used for correcting deviations of the supply characteristics of fuel supply means disposed for the respective cylinders, can be set. Furthermore, the first and second correction values are learned so that they are fit for at least two different driving conditions, and the correction by the feedback control is borne by the first and second correction values so that the air quantity not included in the detected value of the sucked air flow quantity is corrected by the first correction value, and the change of the fuel supply pressure or the like is coped with by the second correction value.

Preferably, each of the correction values for the respective cylinders comprises a correction term for correcting the fuel supply quantity only at a certain ratio and a correction term for correcting the fuel supply quantity only be a certain quantity. By this structure, corrections coping with the clogging of injection holes and the change of the response characteristic, respectively, can be performed.

According to the self-diagnosis method of the present invention, the self-diagnosis of the fuel supply control system is carried out by comparing the correction values for respective cylinders and the first and second correction values, set according to the above-mentioned learning-correcting method, with corresponding predetermined allowable values. According to this method, disorders of the fuel supply means disposed for respective cylinders. The system of detecting the sucked air quantity and the fuel supply system including the fuel supply pressure regulator can be independently diagnosed. When the first correction value exceeds a predetermined allowable value, occurrence of the air leakage is judged and when the correction value for each cylinder exceeds an allowable value, a disorder of the corresponding fuel supply means is judged.

Furthermore, according to the present invention, there is provided a learning-correcting apparatus in a fuel supply control system of an internal combustion engine, which comprises sucked air flow quantity-detecting means for detecting a flow quantity of air sucked into the engine, basic fuel supply quantity-setting means for setting a basic fuel supply quantity based on the sucked air flow quantity detected by the sucked air flow quantity-detecting means, air-fuel ratio-detecting means for detecting the air-fuel ratio of an air-fuel mixture sucked in the engine, feedback correction coefficient-setting means for setting a feedback correction coefficient for correcting the basic fuel supply quantity to bring the air-fuel ratio detected by the air-fuel ratio-detecting means close to a target air-fuel ratio, learning correction coefficient-setting means for respective driving conditions, disposed for setting learning correction coefficients for respective driving conditions by learning a deviation of the feedback correction coefficient from a standard value for each driving condition and setting the learning correction coefficient for each driving condition in a deviation-decreasing direction, supply characteristic learning and setting means for respective cylinders, disposed for forcibly correcting fuel supply quantities for respective cylinders by fuel supply means arranged for respective cylinders and learning and setting a correction value for each cylinder based on the difference between an expected value of the change of the air-fuel ratio obtained by said detection and the detected change of the air-fuel ratio, common correction value learning and setting means for learning and setting a first correction value for correcting the sucked air flow quantity detected by the sucked air flow quantity detecting means only by a predetermined quantity and a second correction value for correcting the basic fuel supply quantity only at a constant ratio, so that the first and second correction values are commonly fit for at least two different driving conditions to make the fuel supply quantity set without using the feedback correction coefficient, equal to the quantity corresponding to the target air-fuel ratio, fuel supply quantity-setting means for setting the fuel supply quantities for respective cylinders based on the basic fuel injection quantity, the feedback correction coefficient, the learning correction coefficients for respective driving conditions, the correction values for respective cylinders, the first correction value and the second correction value, set by said respective means, and fuel supply-controlling means for driving and controlling fuel supply means disposed for respective cylinders based on the fuel supply quantities for respective cylinders set by the fuel supply quantity-setting means.

In the learning-correcting apparatus in a fuel supply control system of an internal combustion engine, which has the above-mentioned structure, the sucked air flow quantity-detecting means detects the flow quantity of sucked air, and the basic fuel supply quantity-setting means sets the basic fuel supply quantity based on this sucked air flow quantity. Furthermore, the air-fuel ratio-detecting means detects the air-fuel ratio of the air-fuel mixture sucked in the engine, and the feedback correction coefficient for correcting the basic fuel supply quantity to bring the detected air-fuel ratio close to the target air-fuel ratio is set by the feedback correction coefficient-setting means.

The learning correction coefficient-setting means for respective driving conditions learns the deviation of the feedback correction coefficient from the standard value for each driving condition and sets the learning correction coefficient for each driving condition in a direction for decreasing this deviation.

The supply characteristic learning and setting means for respective cylinders forcibly corrects the fuel supply quantity by the fuel supply means for each cylinder and learns and sets the correction values for respective cylinders, which are used for correcting the basic supply quantity for respective cylinders to compensate deviations of the fuel characteristics for respective cylinders based on the difference between an expected value of the change of the air-fuel ratio obtained by said correction and the actually detected change of the air-fuel ratio.

Furthermore, the common correction value learning and setting means learns and sets a first correction value for correcting the detected value of the sucked air flow quantity only by a certain quantity and a second correction value for correcting the detected value of the basic fuel supply quantity only at a certain ratio so that the first and second correction values are commonly fit for at least two different conditions to make the fuel supply quantity set without using the feedback correction coefficient, equal to the quantity corresponding to the target air-fuel ratio.

Namely, correction by the feedback correction coefficient is borne by the first and second correction values and is made commonly fit for at least two different driving conditions, whereby the first and second correction values, which are inherently unknown numbers, can be determined. For example, the correction of the leakage air quantity not detected by the sucked air flow quantity-detecting means can be performed by the first correction value, and the correction coping with the change of the fuel supply pressure from the initial value can be performed by the second correction value.

The fuel supply quantity-setting means sets the fuel supply quantity for each cylinder based on the basic fuel injection quantity, feedback correction coefficient, learning correction coefficients for respective driving conditions, correction values for respective cylinders, first correction value and second correction value, and fuel supply means disposed for respective cylinders are driven and controlled, based on the set fuel injection quantity for each cylinder.

When the correction values for respective cylinders are thus learned and set by the means for learning and setting the supply characteristics for respective cylinders, preferably the correction value for each cylinder comprises a correction term for correcting the fuel supply quantity only at a certain ratio and a correction term for correcting the fuel supply quantity only by a certain quantity, so that various corrections required by the clogging of injection holes, the change of response characteristics and the like can be coped with.

In accordance with the present invention, there is provided a self-diagnosis apparatus in a fuel supply control system of an internal combustion engine, which comprises self-diagnosis means for carrying out the self-diagnosis of the fuel supply control system by comparing the correction values for respective cylinders and the first and second correction values, learned and set by said learning-correcting apparatus of the present invention, are compared with predetermined allowable values.

In this self-diagnosis apparatus, the self-diagnosis means compares the correction values for respective cylinders and the first and second correction values, learned and set by the learning-correcting apparatus, with predetermined allowable values, and if there is any correction term where the correction exceeding the allowable value is carried out, a disorder of a part of the fuel supply control system, which is presumed to have a relation to said correction term, is diagnosed.

For example, since the correction values for respective cylinders compensate for deviations in the supply characteristics of the fuel supply means disposed for respective cylinders, when the correction values for respective values are set beyond the allowable levels, a disorder of the fuel supply means can be independently diagnosed for the respective cylinders. Furthermore, since the first correction value corrects the detected value of the sucked air flow quantity only by a certain quantity, if the correction is an increasing correction, the presence of air not detected by the sucked air flow quantity-detecting means, that is, the leakage of air into the suction system of the engine, is diagnosed.

Other objects and aspects of the present invention will become apparent from the following detailed description of the embodiment of the present invention made with reference to the accompanying drawings.

DETAILED DESCRIPTION OF THE PREFERRED EMBODIMENT

Figure 1:
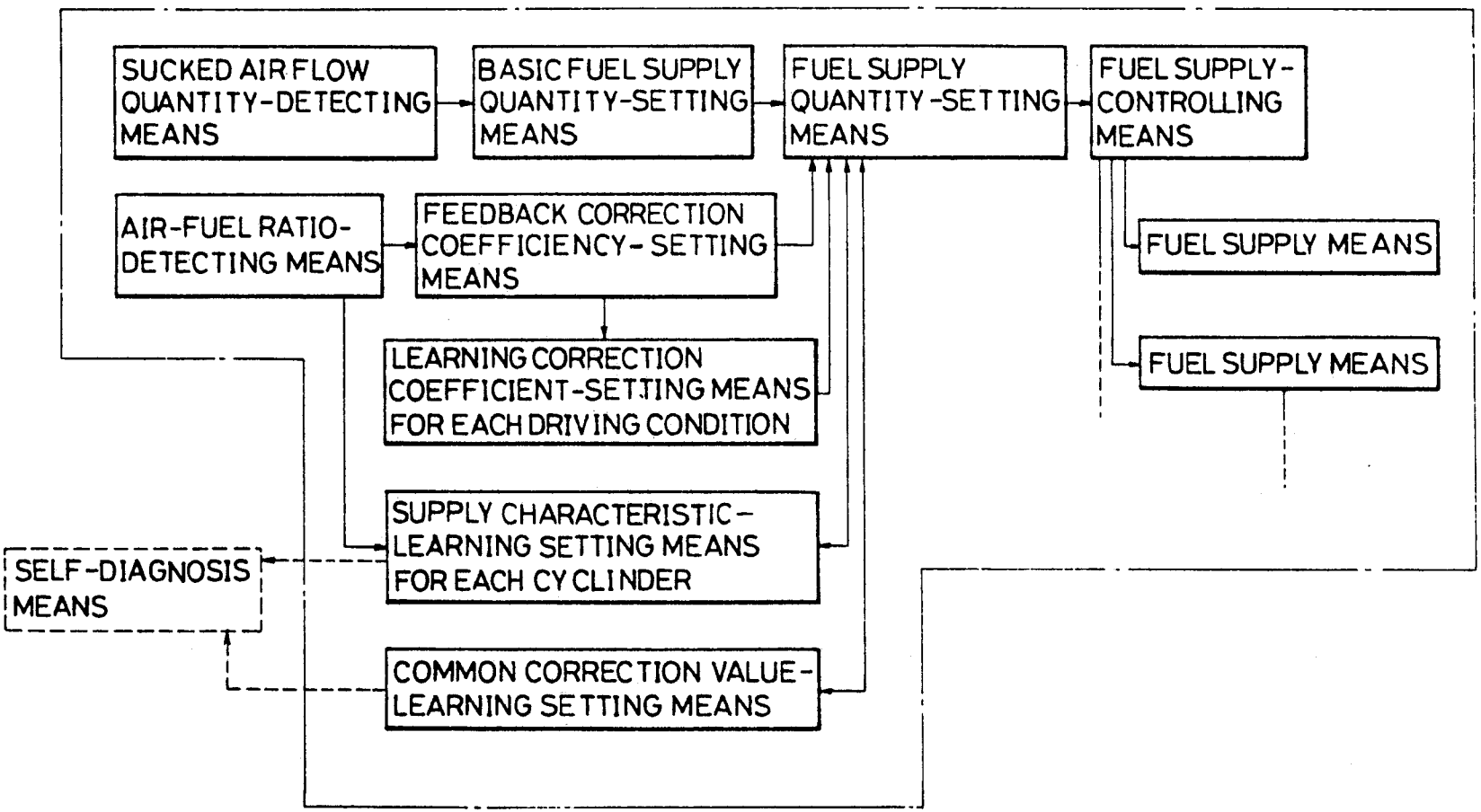
FIG. 1 is a block diagram illustrating the structure of the learning-correcting apparatus and the self-diagnosis apparatus according to the present invention.

The structure of the learning-correcting apparatus and the self-diagnosis apparatus according to the present invention is illustrated in FIG. 1. One embodiment of the learning-correcting apparatus and method and the self-diagnosis apparatus and method according to the present invention is illustrated in FIGS. 2 through 13.

Figure 2:
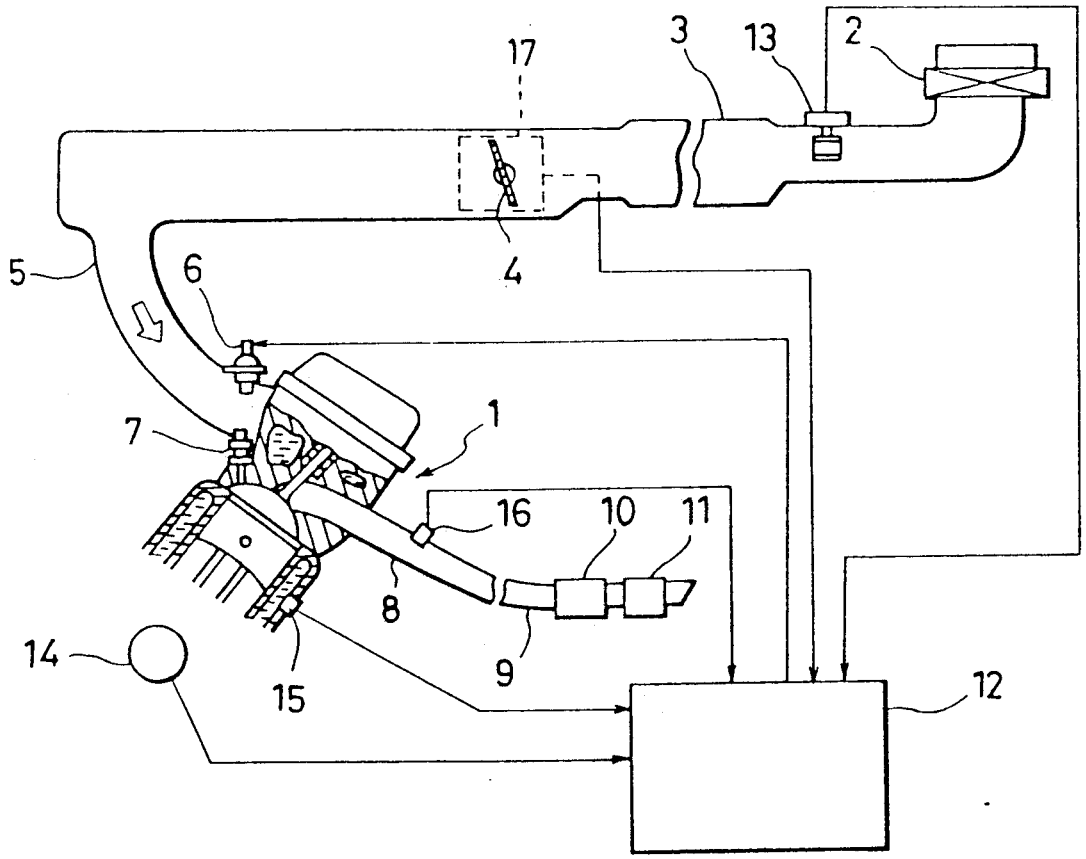
FIG. 2 is a system diagram illustrating one embodiment of the present invention.

Referring to FIG. 2 illustrating the system structure of the present embodiment, air is sucked into an internal combustion engine 1 through an air cleaner 2, a suction duct 3, a throttle chamber 4 and a suction manifold 5. A fuel injection valve 6 is arranged in the branch portion of the manifold 5 as the fuel supply means for each of cylinders (4 cylinders in the present embodiment). The fuel injection valve 6 is an electromagnetic fuel injection valve which is opened by actuating a solenoid and is closed by de-energizing the solenoid. The fuel injection valve 6 is driven and opened by a driving pulse signal emitted from a control unit 12 described hereinafter, and a fuel fed under pressure from a fuel pump F/P and having a pressure regulated at a predetermined level by a pressure regulator P/R is injected and supplied by the fuel injection valve 6.

An ignition plug 7 is arranged in each combustion chamber of the engine 1 to fire and burn an air-fuel mixture by spark ignition.

An exhaust gas is discharged from the engine 1 through an exhaust manifold 8, an exhaust duct 9, a ternary catalyst 10 and a muffler 11. The ternary catalyst 10 oxidizes the CO and HC contained in the exhaust gas and reduces $NO_x$ to convert them to non-toxic substances. The ternary catalyst 10, as the exhaust gas-purging means, shows the highest conversion efficiencies when the air-fuel mixture is burnt at the theoretical air-fuel ratio.

The control unit 12 comprises a microcomputer including CPU, ROM, an A/D converter and an input/output interface, and the control unit 12 receives various input signals from various sensors and performs computing processing described hereinafter, to control the operation of the fuel injection valves 6 for the respective cylinders.

As one of the above-mentioned various sensors, a hot wire type or flap type air flow meter 13 is arranged as the sucked air flow quantity-detecting means in the suction duct 3 to emit a voltage signal corresponding to the sucked air flow quantity Q in the engine 1.

Furthermore, a crank angle sensor 14 is arranged, and in case of a 4-cylinder engine, a reference angle signal REF is emitted at every 180° of the crank angle and a unit angle signal POS is emitted at every 1° or 2° of the crank angle. By measuring the frequency of the reference angle signal REF or the number of unit angle signals POS emitted during a predetermined time, the engine revolution N can be calculated. Moreover, a water temperature sensor 15 is arranged to detect the cooling water temperature Tw of a water jacket of the engine 1.

In an assembly portion of the exhaust manifold 8 (an assembly portion of exhaust paths of the respective cylinders), a known oxygen sensor 16 is arranged as the air-fuel ratio-detecting means to detect the air-fuel ratio of the air-fuel mixture sucked into the engine 1 through the oxygen concentration in the exhaust gas. Still further, a throttle sensor 17 is disposed in the throttle valve 4 to detect the opening degree TVO of the throttle valve 4 by a potentiometer.

The CPU of the microcomputer arranged in the control unit 12 carries out computing processing according to programs on ROM, shown in flow charts of FIGS. 3 through 9, to effect the fuel injection control including learning and correction of the air-fuel ratio and also effect the self-diagnosis of respective parts of the fuel supply control system based on the correction state by the learning and correction of the air-fuel ratio.

Incidentally, the functions of the basic fuel supply quantity-setting means, feedback correction coefficient-setting means, driving condition learning and correction coefficient-setting means for respective driving conditions, supply characteristics learning and setting means for respective cylinders, common correction value learning and setting means, fuel supply quantity-means, fuel supply-control means and self-diagnosis means are exerted according to programs shown in flow charts of FIGS. 3 through 9.

The computing processing of the microcomputer arranged in the control unit 12 will now be described with reference to the flow charts of FIGS. 3 through 9.

The various controls will be outlined before the computing processing is explained with reference to the flow charts of FIGS. 3 through 9. In the present embodiment, for learning and correction for respective cylinders, when the engine 1 shifts to the stable stationary state from the transient state, a predetermined number of the air-fuel ratio feedback correction coefficients LMD used for controlling the air-fuel ratio to the target air-fuel ratio are sampled, and only the air-fuel ratio feedback correction coefficient LMD of the specific one cylinder is corrected by a predetermined value Z (1.16 in the present embodiment). Furthermore, a predetermined number of the air-fuel ratio feedback correction coefficients LMD used for controlling the air-fuel ratio to the target air-fuel ratio in this fuel-corrected state are sampled.

Based on the actual change of the air-fuel ratio feedback correction coefficient LMD relative to the change expected by the correction by the predetermined value Z, the error of the supply characteristics of the fuel injection valve 6 of the cylinder where the air-fuel ratio feedback correction coefficient LMD is corrected by the predetermined value Z is detected for each cylinder, and the correction value for each cylinder for correcting the fuel supply quantity Ti for eliminating this error is learned for each cylinder based on the manner of the change of the error quantity relative to the change of the fuel supply quantity and the fuel supply quantity matched to each cylinder is set according to this correction value.

In the calculation equations of the fuel injection quantity Ti to be calculated under two different driving conditions, ΔQ (first correction value) for correcting the detected value of the sucked air flow quantity Q by a certain quantity and PRFP (second correction value) for correcting the basic fuel injection quantity Tp at a certain ratio are determined by solving the simultaneous equations for calculation of Ti so that Ti corresponding to the target air-fuel ratio can be obtained without using the air-fuel ratio feedback correction coefficient LMD.

The deviation of the air-fuel ratio feedback correction coefficient LMD from the reference value is learned for each driving condition, and a learning correction coefficient KBLRC coping with the change of the required correction for each driving condition is learned and set.

The self-diagnosis of the fuel supply control system is carried out based on the quantity of the error of the supply characteristics detected for each cylinder, the correction value learned for each cylinder, and the correction values ΔQ and PREF determined in the above-mentioned manner so that they are commonly fit for two different driving conditions.

The control will now be described in detail with reference to the flow charts of FIGS. 3 through 9.

Figures 1, 3:
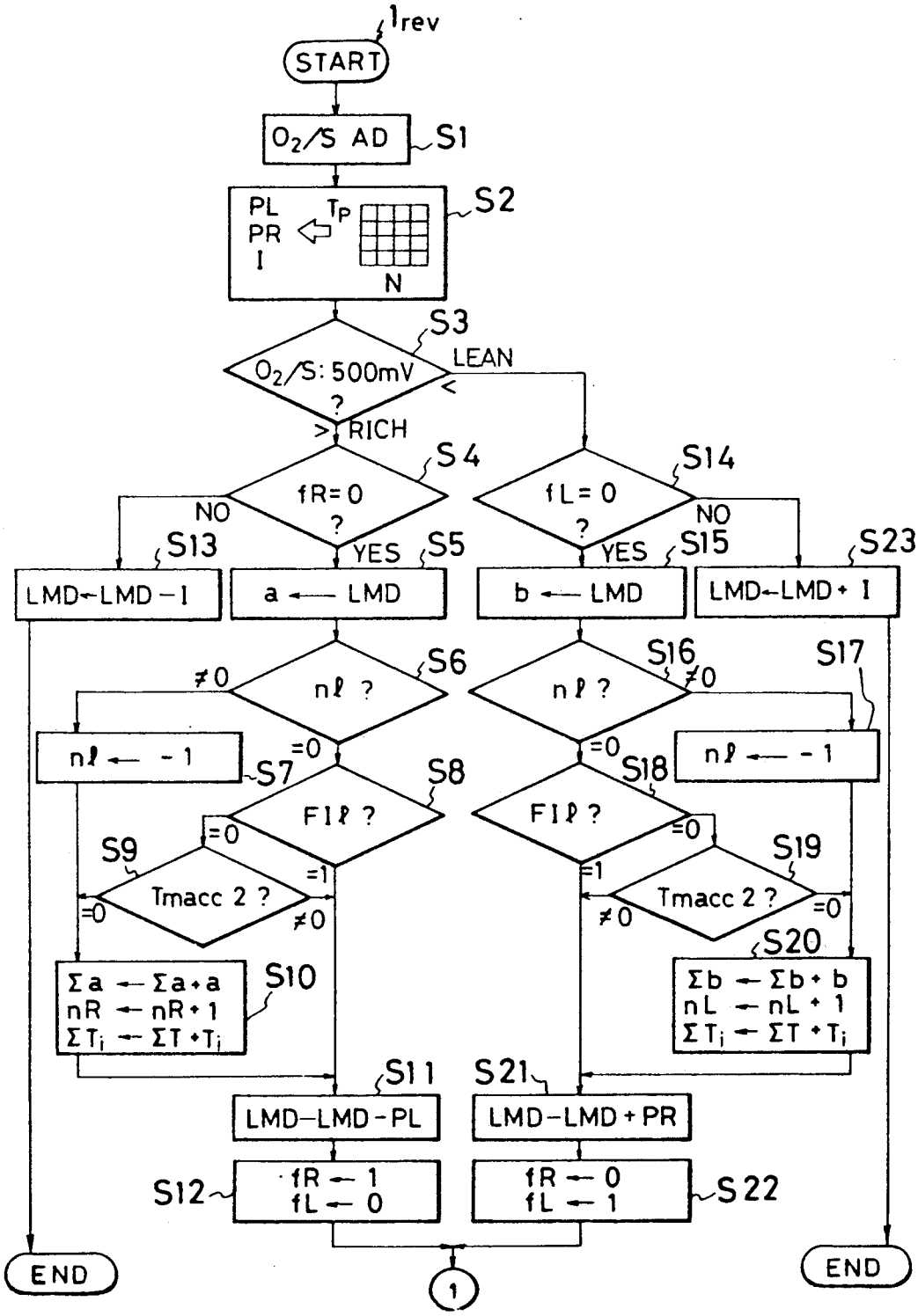
FIG. 3(3-1 to 3-4) (4-1 to 4-2) (5-1 to 5-2) (6-1 to 6-2) (7, 8) through 9 are flow charts showing the contents of controls in the above-mentioned embodiment.
Figures 2, 3:
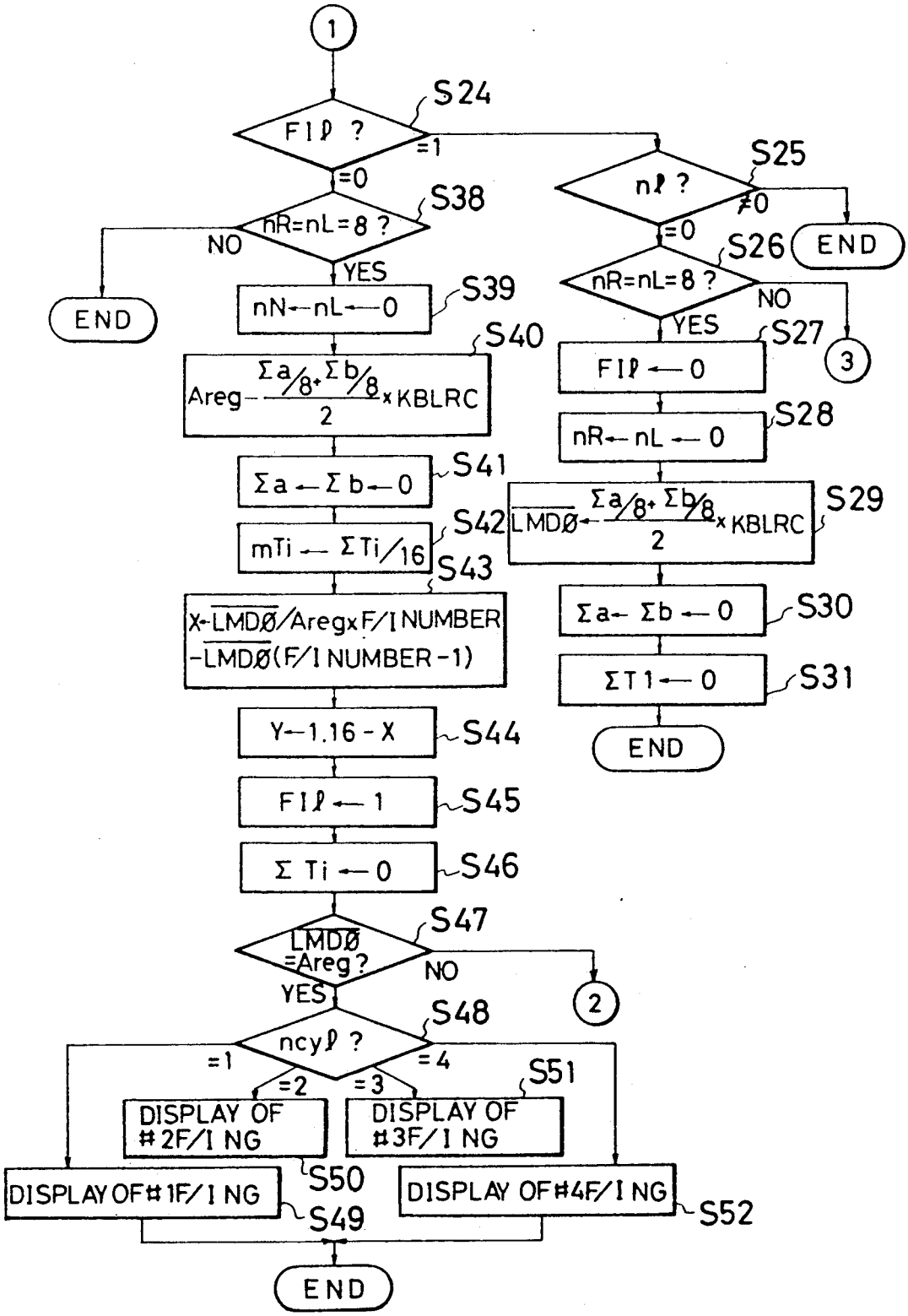
Figure 3:
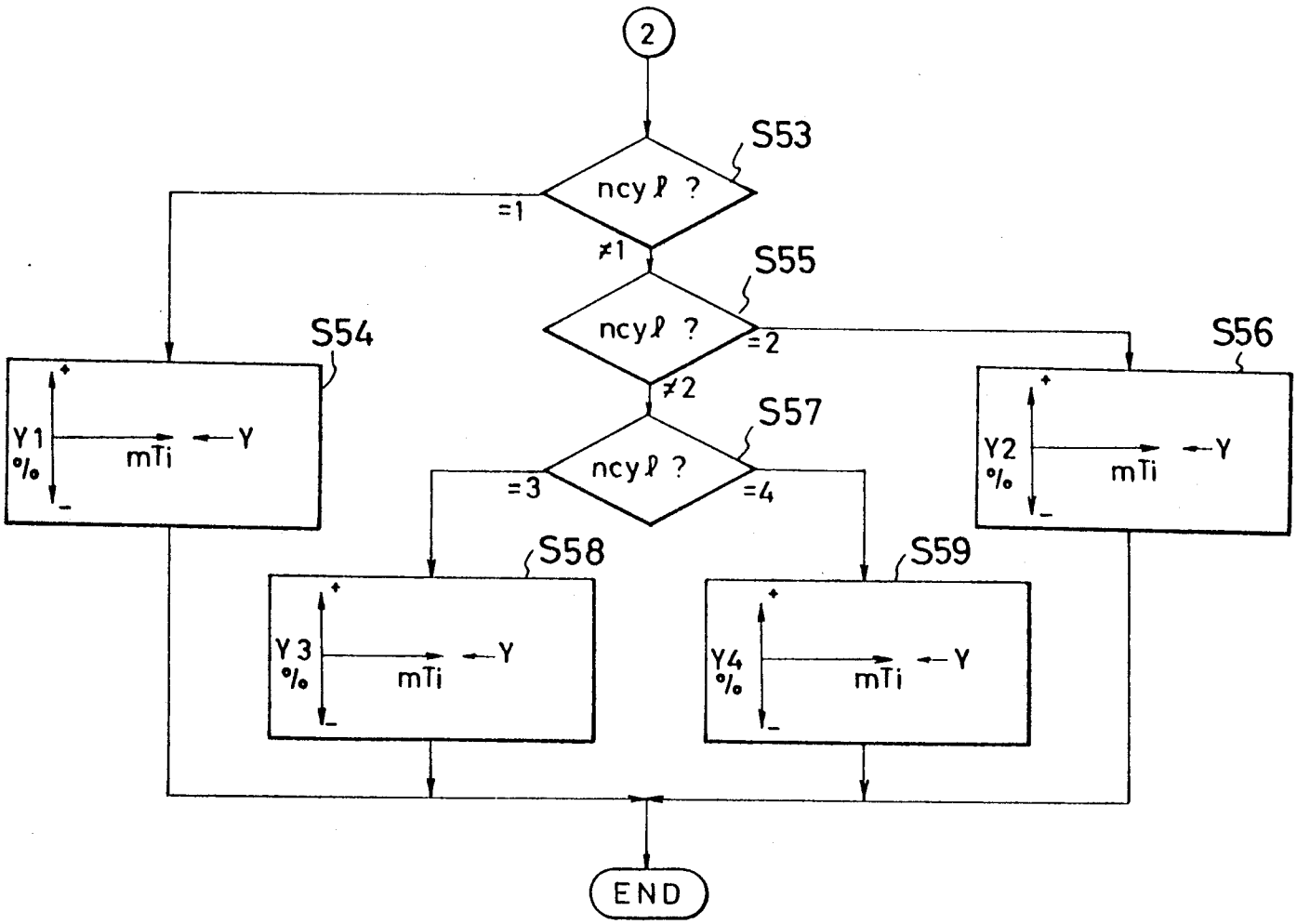

The routine of the feedback control of the air-fuel ratio shown in FIG. 3 is executed at every revolution (1 rev) of the engine 1, and according to this routine, the proportional-integral control of the air-fuel ratio feedback correction coefficient LMD and the detection of the quantity of the supply error of the fuel injection valve 6 for each cylinder are carried out.

At first, at step 1 (indicated as S1 in the drawings; subsequent steps are similarly indicated), a detection signal (voltage) from the oxygen sensor ($O_2$/S) 16 is received after A/D conversion.

At next step 2, the operation quantity data are retrieved from a map where the operation quantities of the air-fuel ratio feedback correction coefficient LMD are preliminarily stored for respecive driving states defined by the engine revolution number N and the basic fuel injection quantity (basic fuel supply quantity) set according to a different routine described hereinafter.

The air-fuel ratio feedback correction coeficient LMD is used for the correction and calculation of the basic fuel injection quantity Tp and is set so that the air-fuel ratio detected by the oxygen sensor 16 is brought close to the target air-fuel ratio (theoretical air-fuel ratio). In the present embodiment, the operation quantity set and controlled by the proportional-integral control and retrieved from the map includes a proportional component PR of the rich control, a proportional component PL of the lean control and an integral component I.

At step 3, the output of the oxygen sensor 16 obtained by A/D conversion at step 1 is compared with a slice level (for example, 500 mV) corresponding to the target air-fuel ratio, and it is judged whether the air-fuel ratio of the air-fuel mixture sucked in the engine is rich or lean as compared with the target air-fuel ratio (theoretical air-fuel ratio).

When it is judged that the output of the oxygen sensor 16 is higher than the slice level and the air-fuel ratio is rich, as compared with the target air-fuel ratio, the routine goes into step 4, and a flag fR for judging the initial rich state is checked. In the state where the air-fuel ratio is lean, zero is set at the flag fR for judging the initial rich state and, therefore, in the case where the rich state is first detected at this time, it is judged at step 4 the flag fR for judging the initial rich state is at zero.

If the flag fR is at zero and the rich state is first detected, the routine goes into step 5, and the preliminarily set value of the air-fuel ratio correction coefficient LAD, that is, the air-fuel ratio feedback correction coefficient LMD just before the lean-to-rich reversal of the air-fuel ratio, is set at the maximum value (peak value) a.

At the next step 6, it is judged whether or not a normal learning counter nl (see FIG. 10), at which a predetermined value is set at the initial transition to the stationary driving from the transient driving as described hereinafter, is at zero. When the normal learning counter nl is not at zero, the routine goes into step 7 and the value of the ordinary learning counter nl is counted down by 1. At next step 10, the value a set at step 5 is added to the previous integration value Σs to effect renewal of the integration value Σa. Simultaneously, the value of an initial rich state counter nR is counted up by 1 and the newest value of Ti added to the integration value ΣTi of the fuel injection quantity Ti to effect renewal of ΣTi.

Namely, after the predetermined value is set at the normal learning counter nl at the initial transition to the stationary driving from the transient driving, the counter nl is counted down by 1 at every initial rich state detection, and at every inch counting-down, the maximum value a of the air-fuel ratio feedback correction coefficient LMD and the fuel injection quantity Ti are added and simultaneously, the value of the initial rich state counter nR is counted up by 1. Date collected while the normal learning counter nl is counted down are compared with data collected during the period of learning of the fuel injection valve 6 to detect a quantity of the supply error of the fuel injection valve 6.

Incidentally, at the initial detection of the lean state, as described hereinafter, the minimum value b of the air-fuel ratio feedback correction coefficient and the fuel injection Ti are added, and the value of the initial rich state counter nL is counted up by 1.

On the other hand, when it is judged at step 6 that the normal learning counter nl is at zero, the routine goes into step 8 and an F/I learning Flag FII for judging the learning period of the fuel injection valve (F/I) 6 is checked. When the F/I learning flag FII is at zero and the fuel injection valve 6 is during the learning for each cylinder, the routine goes into step 9 and it is judged whether or not a timer Tmacc2 (see FIG. 10) for measuring the period of the inhibition of the F/I learning (data sampling) from the point when the F/I learning flag FI has become at zero or is zero.

When the time Tmacc2 is not at zero and a time longer than the predeterimned time does not elapse after the point when the F/I learning flag FII has become at zero, step 10 is skipped and the routine goes into step 11. On the other hand, when the time Tmacc2 is at zero, the routine goes into step 10, and addition of the maximum value a of LMD and the fuel injection quantity Ti is effected and the value of the initial rich state counter nR is counted up by 1.

Namely, during the period to the point when zero is set at the normal learning counter nl and while the F/I learning flag FII is at zero and the timer Tmacc2 is at zero, Σa and ΣTi are calculated, respectively, and simultaneously, the value of the counter nR is counted up. When the normal learning counter nl is at zero and the F/I learning flag FII is at 1, and when the normal learning counter nl is at zero and the timer Tmacc2 is not at zero, addition of Σa and ΣTi or counting-up of nR is not affected. This control is commonly carried out with respect to addition of Σb and ΣTi and counting-up of nL at the initial detection of the lean state.

When zero is set at the F/I learning flag FII, as described hereinafter, only the air-fuel ratio feedback correction coefficient LMD of specific one cylinder is corrected by the predetermined value Z and the subsequent move of the air-fuel ratio feedback correction coefficient LMD is inspected. The time required for the air-fuel ratio feedback correction coefficient to settle at a value matched to the above-mentioned correction is detected by the time Tmacc2.

At step 11, the proportional component PL of the lean control retrieved at step 2 is subtracted from the previous air-fuel ratio feedback correction coefficient LMD.

After the proportional control of the air-fuel ratio feedback correction coefficient LMD by the proportional component PL of the lean control, 1 is set at the initial rich state judging flag fR at step 12 and simultaneously, zero is set at the initial lean state judging flag fL. While the rich state of the air-fuel ratio is continued, it is judged at step 4 that the initial rich state judging flag fR is at 1, and the routing goes into step 13.

At step 13, the integral component I retrieved at step 2 is subtratcted from the precedent value of the air-fuel ratio feedback correction coefficient LMD, and the obtained result is set as the new air-fuel ratio feedback correction coefficient LMD.

When the rich state of the air-fuel ratio is cancelled by decrease of the air-fuel ratio feedback correction coefficient LMD by the integral control and it is judged at step 3 that the output of the oxygen sensor 16 is lower than the slice level level and the air-fuel ratio is lean as compared with the target air-fuel ratio, the routine goes into step 14, and the initial lean state judging flag fL is checked.

Zero is set at the initial lean state judging flag fL at step 12 where the air-fuel ratio is rich, and if the lean state is initially detected at this time, it is judged at step 14 that fL is at zero.

If fL is at zero and the lean state is initially detected, the routine goes into step 15, and the air-fuel ratio feedback correction coefficient LMD at this time, that is, the air-fuel ratio feedback correction coefficient LMD just before rich-to-lean reversal of the air-fuel ratio, is set as the minimum value (peak value) b.

Then, at step 16, it is judged whether or not the normal learning counter nl (see FIG. 10) is at zero, as in case of the initial rich state detection. When the normal learning counter nl is not at zero, the routine goes into step 17, and the value of the normal learning counter nl is counted down by 1. At the next step 20, b set at step 15 is added to the precedent integration value Σb to renew the integration value Σb, and simultaneously, the value of the lean state detection counter nL is counted up by 1 and the newest value of Ti is added to the integration value ΣTi of the fuel injection quantity Ti to renew ΣTi.

On the other hand, when it is judged at step 16 that the normal learning counter nl is at zero, the routine goes into step 18, and the F/I learning flag fII for judging the learning period of the fuel injection valve (F/I) 6 is checked. When the F/I learning flag FII is at zero and the fuel injection valve 6 is during the learning period for each cylinder, the routine goes into step 19, and it is judged whether or not the timer Tmacc2 (see FIG. 10) for measuring the period of inhibition of the F/I learning (data sampling) from the point when the F/I learning flag FIl has become at zero is at zero.

When the timer Tmacc2 is not at zero, step 20 is skipped and the routine goes into step 21. When the timer Tmacc is at zero, the routine goes into step 20, and addition of the minimum value b of LMD and the fuel injection quantity Ti is carried out and the value of the initial lean state counter nL is counted up by 1.

Namely, by the above-mentioned calculation processing, while the normal learning counter nl is not at zero, at every reversal of the air-fuel ratio, data of the maximum and minimum values a and b of the air-fuel feedback correction coefficient LMD and the fuel injection quantity Ti are collected. Even when the normal learning counter nl is at zero, if the F/I learning flag FIl is at zero and a time exceeding the predetermined time elapses from the point when the FIl has become zero, data of the maximum and minimum values a and b of the air-fuel ratio feedback correction coefficient LMD and the fuel injection quantity Ti are similarly collected, and the values of rich and lean reversal counters nR and nL ar counted up.

Data collected when the normal learning counter nl is not at zero are data at the normal fuel control, and data collected when the F/I learning flag FIl is at zero are data at the learning of the fuel injection valve 6 for each cylinder (the fuel supply is controlled by correcting only the air-fuel ratio feedback correction coefficient LMD of one specific cylinder by the predetermined value Z).

At step 21, the proportional component PR of the rich control retrieved at step 2 is added to the precedent air-fuel ratio feedback correction coefficient LMD.

After the proportional control of the air-fuel ratio feedback correction coefficient LMD by the proportional component PR of the rich control, zero is set at the initial rich state judging flag fR at step 22, and 1 is set at the initial lean state judging flag fL.

While the lean state of the air-fuel ratio is continued, it is judged at step 14 that the initial lean state judging flag fL is at 1, and the routine goes into step 23.

At step 23, the integral portion I retrieved at step 2 is added to the precedent value of the air-fuel ratio feedback correction coefficient LMD, and the obtained result is newly set as the air-fuel ratio feedback correction coefficient LMD.

At the initial detection of the rich/lean state, computing processings of step 24 and subsequent steps are further conducted.

At step 24, the F/I learning flag FIl is checked, and when the F/I learning flag FIl is at 1, that is, when the learning of the fuel injection valve of one specific cylinder is not carried out, the routine goes into step 25. At step 25, the normal learning counter nl is checked, and when the normal learning counter nl is not at zero, the present routine is ended. When the normal learning couner nl is at zero, the routine goes into step 26.

At step 26, it is judged whether or not both of nR and nL for counting the number of rich/lean reversals are at 8, and if it is judged that both of nR and nL are set at 8, this indicates that the number of the reversals of the air-fuel ratio during the period of counting-down of the normal learning counter nl from the predetermined value is the prescribed number. Therefore, the routine goes into step 27 and subsequent steps, and the air-fuel ratio feedback correction coefficient LMD before the learning of F/I is learned.

Namely, in the present embodiment, if the predetermined time Tmacc elapses from the transition to the stationary driving state from the transient driving state, the normal learning counter nl is counted down form the predetermined value from this point, and data of the peak values a and b of the air-fuel ratio feedback correction coefficient LMD and the fuel injection quantity Ti are collected until the normal learning counter nl is counted down to zero. The thus collected data are compared with data, to be collected at the next learning of the fuel injection valve 6 for each cylinder. Based on the results of this comparision, an error in the supply characteristics of the fuel injection valve 6 is detected, and the state of $nR+nL=8$ indicates that the collection of data during the period to the point of counting-down of the normal learning counter nl to zero is completed.

At step 27, since data for initiating the learning of the fuel injection valve 6 have been collected, zero is set at the f/I learning flag FIl, and at next step 28, NR and NL which have been counted up during the period to the point of counting-down of the normal learning counter nl to zero are reset at zero.

At step, 29, the mean value $[(\Sigma a/8+\Sigma b/8)/2]$ of the medians of the air-fuel ratio feedback correction coefficient LMD is determined from $\Sigma a$ and $\Sigma b$ sampled during the period to counting-down of the normal learning counter nl to zero, and the value obtained by multiplying this mean value by the air-fuel ratio feedback correction coefficient KBLRC learned at every driving state is set as the initial value $\overline{LMD}\phi$ (the value before the learning of F/I) of the air-fuel ratio feedback correction coefficient LMD.

The air-fuel ratio correction coefficient KBLRC is learned so that the basic air-fuel ratio obtained without using the air-fuel ratio feedback correction coefficient LMD is made equal to the target air-fuel ratio, except when the control concerning the learning of the fuel injection valve for each cylinder is carried out, and the correction coefficient KBLRC is learned and stored according to respective driving conditions sorted by the sucked air flow quantity Q.

At next step 30, $\Sigma a$ and $\Sigma b$ sampled during the period to the point of counting-down of the normal learning counter nl to zero are reset at zero, and at next step 31, $\Sigma Ti$ is reset at rest at zero.

On the other hand, if it is judged at step 26 that nR and nL are not at 8, this indicates the normal control state where the calculation processing concerning the learning of the fuel injection valve 6 for each cylinder is not performed, at step 32 and subsequent steps, the air-fuel ratio learning correction coefficient KBLRC is learned and set.

At step 32, it is judged whether or not nR and nL are at zero, and when it is judged that nR and nL are not zero, the present routine is ended. When nR and nL are at zero, the routine goes into step 33, and the air-fuel ratio learning correction coefficient KBLRC corresponding to the present driving state is retrieved from a map where the air-fuel ratio learning correction coefficients KBLRC corresponding to respective sucked air flow quantities Q are stored.

At step 34, a weighted mean between the median $[(a+b)/2]$ of the air-fuel ratio feedback correction coefficient LMD determined from upper and lower peak values a and b of the correction coefficient LMD and the air-fuel ratio learning correction coefficient KBLRC is determined by using a predetermined value M according to the following equation to obtain a new air-fuel ratio learning correction coefficient KBLRC corresponding to the present driving state:

$$KBLRC \leftarrow \frac{a+b}{2}(1-M) + KBLRC \times M$$

At step 35, the map data are rewritten using the new air-fuel ratio learning correction coefficient KBLRC, determined at step 34, as the data for renewing the correction coefficient KBLRC stored in correspondence to the sucked air flow quantity Q.

On the other hand, when it is judged at step 24 that the F/I learning flag FII is at zero, this indicates the state at which the learning of the fuel injection valve 6 for each cylinder is carried out, and as described hereinafter, in order to detect an error of the supply characteristics of the fuel injection valve 6 of one specific cylinder, only the air-fuel ratio feedback correction coefficient for said specific cylinder is corrected by the predetermined value. Also in this state, if the normal learning counter nl is not at zero, date of Σa,Σb and ΣTi are similarly collected and nR and nL for counting the number of reversals of the air-fuel ratio are counted up from zero.

Accordingly, at next step 38, it is judged whether or not both of nR and nL are at zero, and it is judged whether or not the air-fuel ratio has been reversed at frequencies exceeding a predetermined level from the start of the learning of the fuel injection valve 6. When it is judged at this step that nR and nL are not at zero, the number of data collected at the learning of the fuel injection valve 6 is small and high-precision learning is impossible. Therefore, the present routine is ended. When both of nR and nL are zero, this indicates that a predetermined number of data have been collected. Accordingly, the routine goes into step 36 and subsequent steps, and an error of the supply characteristics at the fuel injection valve 6 of the cylinder where the fuel correction (LMD correction) is executed is detected.

At step 39, nR and nL which have been counted up in the state where the F/I learning flag FI is at zero are reset at zero.

At step 40, the correction coefficient Areg used for controlling the actual air-fuel ratio to the target air fuel ratio when the F/I learning flag FII is at zero and only the air-fuel ratio feedback correction coefficient LMD of specific one cylinder is corrected by the predetermined value is calculated according to the following equation:

$$Areg \leftarrow \frac{\Sigma a/8 + \Sigma b/8}{2} \times KBLRC$$

Namely, this correction coefficient Areg is equivalent to $\overline{LMD}\phi$ used for the control of the air-fuel ratio when the normal learning counter nl is at zero, and this correction coefficient is a coefficient of the basic fuel injection quantity Tp required to control the average air-fuel ratio in the respective cylinders to the target air-fuel ratio as the result of the correction of only the air-fuel ratio feedback correction coefficient LMD of one specific cylinder by the predetermined value Z.

At next step 41, Σa and Σb, which are the data used at the learning of the fuel injection valve 6 for the calculation at step 40, are reset at zero.

At step 42, the integration value ΣTi of the fuel injection quantity Ti obtained at the integration simultaneously with the integration of Σa and Σb is divided by the sampling number, that is, 16, and the obtained value is set as the mean value mTi at the learning of F/I.

At next step 43, the predetermined value Z is obtained by reckoning backward from the result obtained by correcting only the air-fuel ratio feedback correction coefficient LMD of one specific cylinder by the predetermined value Z according to the following equation:

$$X \leftarrow LMD\phi/[Areg \times \text{number of } F/I - LMD\phi(\text{number of } F/I - 1)]$$

Namely, in the present embodiment, in detecting an error of the supply characteristics of each fuel injection valve 6, only the air-fuel ratio feedback correction coefficient LMD of one specific cylinder is multiplied by the predetermined value (1.16) to calculate the fuel injection quantity Ti, and only in said one specific cylinder, the fuel control is carried out under the fuel injection quantity Ti defined by the predetermined value Z and the error of the supply characteristics of said fuel injection valve 6 is detected based on whether or not the result of this control is manifested on the air-fuel ratio feedback correction control, as expected. The above-mentioned equation for the calculation of X (backward reckoning value of the predetermined value Z) is derived in the following manner.

Supposing that if the fuel of one specific cylinder is corrected, the feedback correction of the air-fuel ratio is effected only in said one specific cylinder, when the air-fuel ratio correction coefficient $\overline{LMD}\phi$ before the correction of the fuel is changed to $\overline{LMD}\phi/Z$, the correction of the air-fuel ratio feedback correction coefficient LMD by the prescribed value Z should be cancelled and the air-fuel ratio should be return to the target air-fuel ratio. On the other hand, in other cylinders where the air-fuel ratio feedback correction coefficient LMD is not corrected by the predetermined value Z, even if the feedback correction is independently carried out in these cylinders, the air-fuel ratio correction coefficient $\overline{LMD}\phi$ is not changed. Since the air-fuel ratio feedback correction based on the result of the detection of the oxygen sensor 16 is made to control the mean air-fuel ratio in all the cylinders to the target air-fuel ratio, the air-fuel ratio correction coefficient $\overline{LMD}$ obtained by correcting only the air-fuel ratio feedback correction coefficient LMD of one specific cylinder (the correction coefficient obtained by multiplying the air-fuel ratio feedback correction coefficient LMD by the air-fuel ratio learning correction coefficient KBLRC) should be obtained as the mean value in the respective cylinders.

Accordingly, the air-fuel ratio correction coefficient $\overline{LMD}$ required for controlling the airfuel ratio to the target air-fuel ratio when only the fuel of one specific cylinder is corrected by the predetermined value Z is expressed as follows:

$$LMD \leftarrow \frac{LMD\phi/Z + LMD\phi(\text{number of } Fi - 1)}{\text{number of } F/I}$$

Since the air-fuel ratio correction coefficient required for controlling the air-fuel ratio to the target air-fuel ratio when only the air-fuel ratio feedback correction coefficient LMD of one specific cylinder is corrected by the predetermined value Z is obtained as Areg at step 40, this predetermined value can be reckoned backward by substituting this Areg for $\overline{LMD}$ of the above equation. This backward reckoning equation is the equation for the calculation of X, and if the fuel injection valve 6 of the cylinder where correction by the predetermined value Z is normal, this predetermined value Z should be substantially equal to the predetermined value Z obtained by the backward reckoning according to the above equation. If a difference is brought about between the two values, this indicates that in the fuel injection valve 6 of the cylinder where the fuel correction is effected, the fuel is not precisely injected in an amount corresponding to the correction by the predetermined value Z, and an error of the supply characteristics in an amount corresponding to this difference in said cylinder is detected.

Accordingly, at next step 44, the difference Y[←1.16 (Z)−X] between X calculated at step 43 and the predetermined value Z (1.16 in the present embodiment) practically used for the correction of the fuel injection quantity Ti is calculated. This Y corresponds to the error rate (quantity) of the supply characteristics of the fuel injection valve 6 of the learned cylinder. If the fuel injection valve 6 injects the fuel only in an amount smaller than the predetermined quantity, X is smaller than the predetermined value, Z, and, therefore, in this case, Y is a positive value and though Y is the error rate, Y can be regarded as the value to be corrected in said cylinder.

Since Y corresponding to the error of the supply characteristics of the cylinder where the fuel corrected at this time is calculated at step 44. At next step 45, 1 is set at the F/I learning flag FIl; and at next step 46, ΣTi is reset at zero.

Furthermore, at step 47, it is judged whether or not the air-fuel ratio correction coefficient Areg determined at step 40 is substantially equal to the initial value $\overline{LMD}\phi$ determined in the normal fuel control state before the learning of the fuel injection valve 6. Since Areg is the data obtained when the fuel of one specific cylinder is corrected, in the normal state, Areg should change relatively to the initial value $\overline{LMD}\phi$. In the case where the air-fuel ratio correction coefficient does not change even if the fuel of one specific cylinder is corrected, it is presumed that the driving control of the fuel injection valve 6 of said cylinder is impossible because of braking or short-circuit of the circuit.

Accordingly, when it is judged at step 47 that $\overline{LMD}\phi$ is equal to Areg, the fuel injection valve 6 of the cylinder where the correction of the fuel is performed is out of order, and therefore, the number ncyl of the corrected cylinder where the F/I learning is carried out is judged at step 48 and at steps 49 through 52, it is displayed on a dashboard of a vehicle or the like that the fuel injection valve 6 of the corrected cylinder is out of order (NG). If the cylinder where control is impossible is thus displayed, a maintenance operation such as exchange of the fuel injection valve 6 can be promptly performed and continuous use of the fuel injection valve 6 where the control is impossible can be prevented.

On the other hand, when it is judged at step 47 that $\overline{LMD}\phi$ is not equal to Areg, since the disorder of the fuel injection valve 6 cannot be immediately judged even though there is an error of the supply characteristics. At step 53 through 59, the error rate Y of the supply characteristics detected at this time is stored independently for the respective cylinders in correspondence to the fuel injection quantity mTi.

At step 53, it is judged whether or not ncyl at which the number of the cylinder where the fuel is corrected for the learning of F/I is 1, and when ncyl is 1 and the learning is performed with respect to the fuel injection valve 6 of the cylinder #1, the error rate Y determined at step 44 is stored as the data of the map where the error rate Y1 of the cylinder #1 is stored in correspondence to the average fuel injection quantity mTi determined at step 42.

When it is judged at step 53 that ncyl is not 1, it is judged at step 55 whether or not ncyl is 2. When it is judged that ncyl is 2, the routine goes into step 56, and the error rate Y determined at step 44 is stored as the data of the map where the error rate Y2 of the cylinder #2 is stored in correspondence to the average fuel injection quantity mTi.

When it is judged at step 55 that ncyl is not 2, it is judged at step 57 whether ncyl is 3 or 4, and when it is judged that ncyl is 3, at step 58, Y is stored in the map of the error rate Y3 of the cylinder #3. When it is judged that ncyl is 4, at step 49, Y is stored in the map of the errorr rate Y4 of the cylinder #4.

If the error rates Y detected independently for the respective cylinders are thus stored independently for the respective cylinders in correspondence to the fuel injection quantity mTi, it is impossible to judge how the error rates Y1 through Y4 of the fuel injection valves 6 of the respective cylinders changes relatively to the change of the fuel injection quantity Ti, and based on the result of this judgement, it is possible to judge what correction should be made to the calculation of the fuel injection quantity Ti of each cylinder in order to perform the intended control of the fuel supply in each cylinder. Furthermore, based on the above-mentioned result, it becomes possible to diagnose a disorderr of the fuel injection valve 6.

Figures 3, 4:
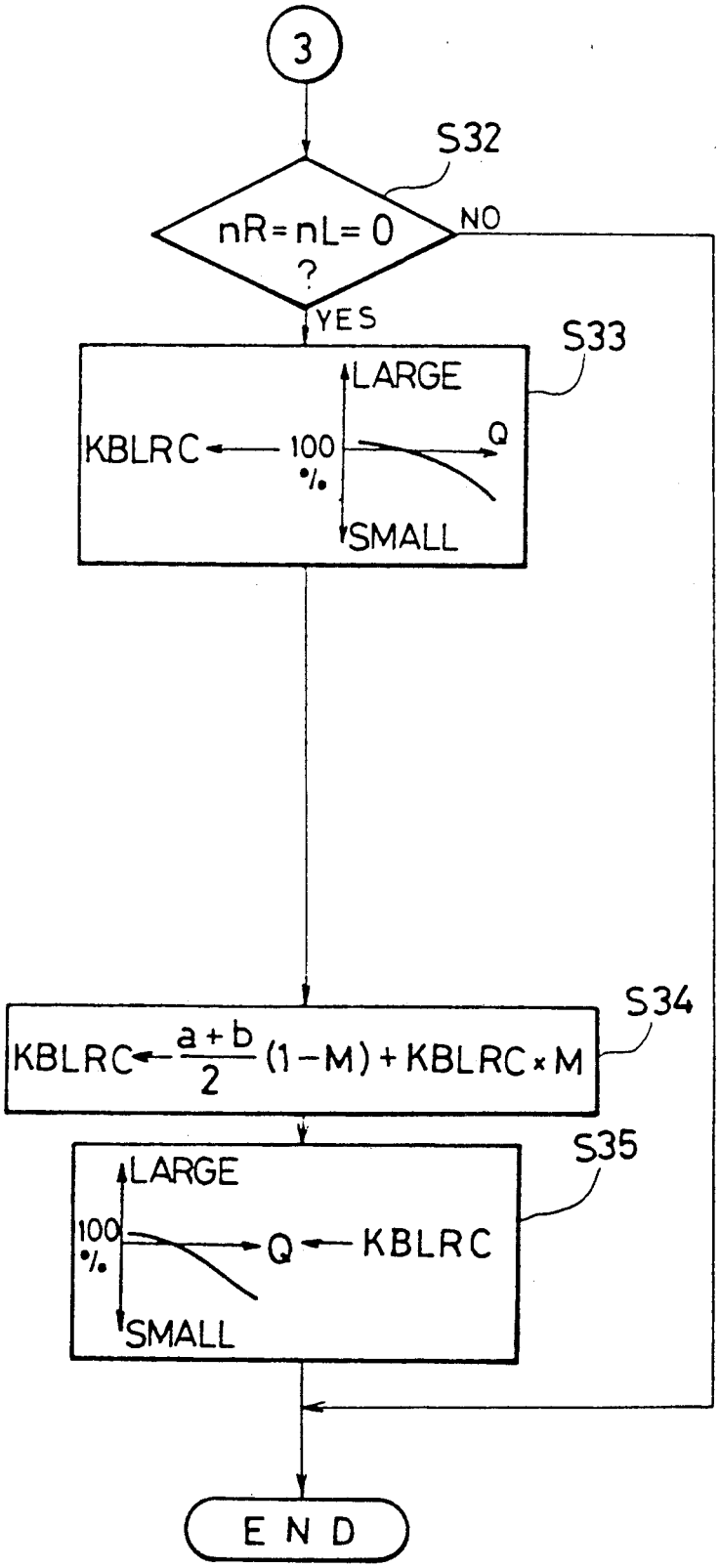
Figures 1, 4:
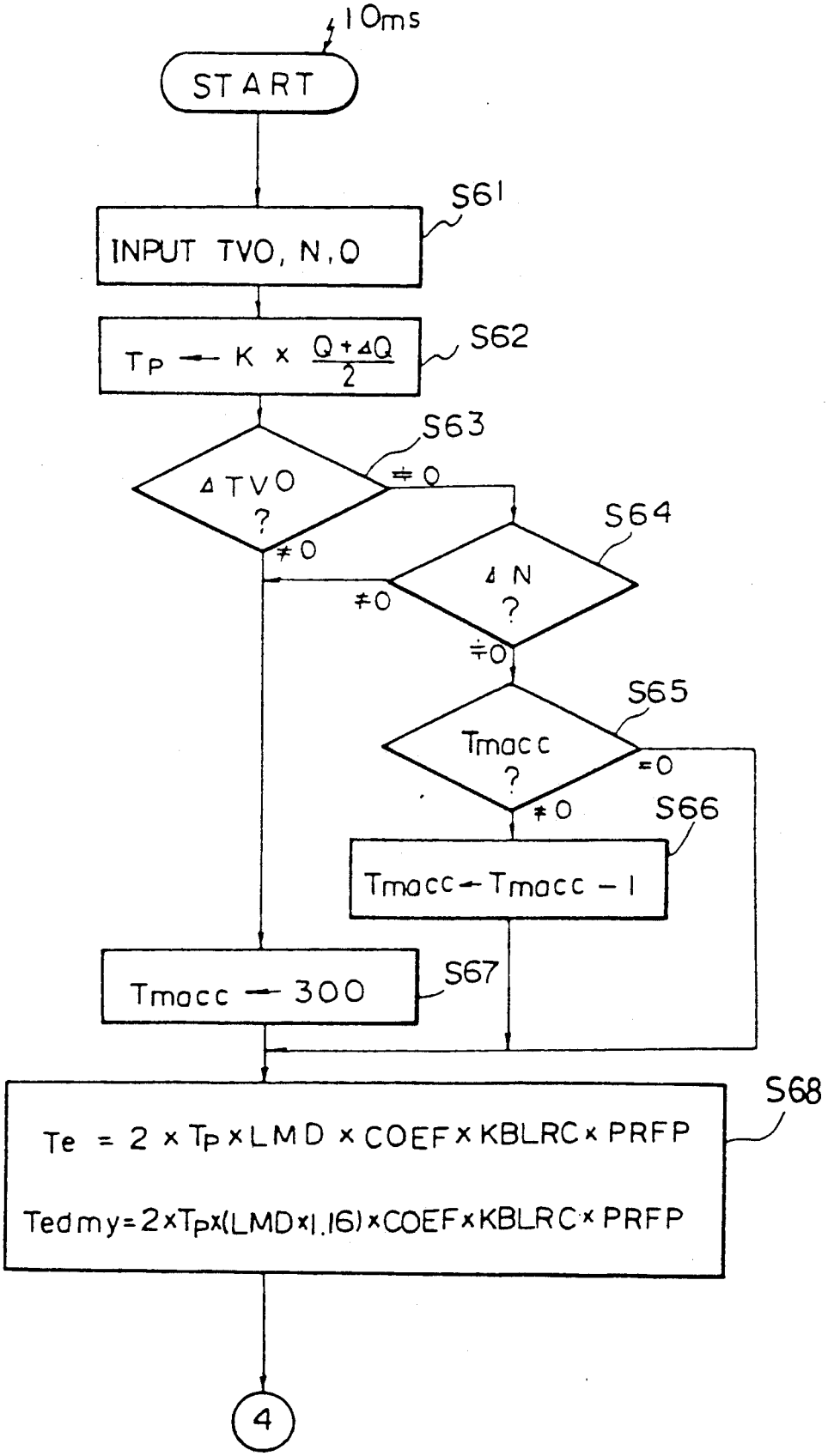
Figures 2, 4:
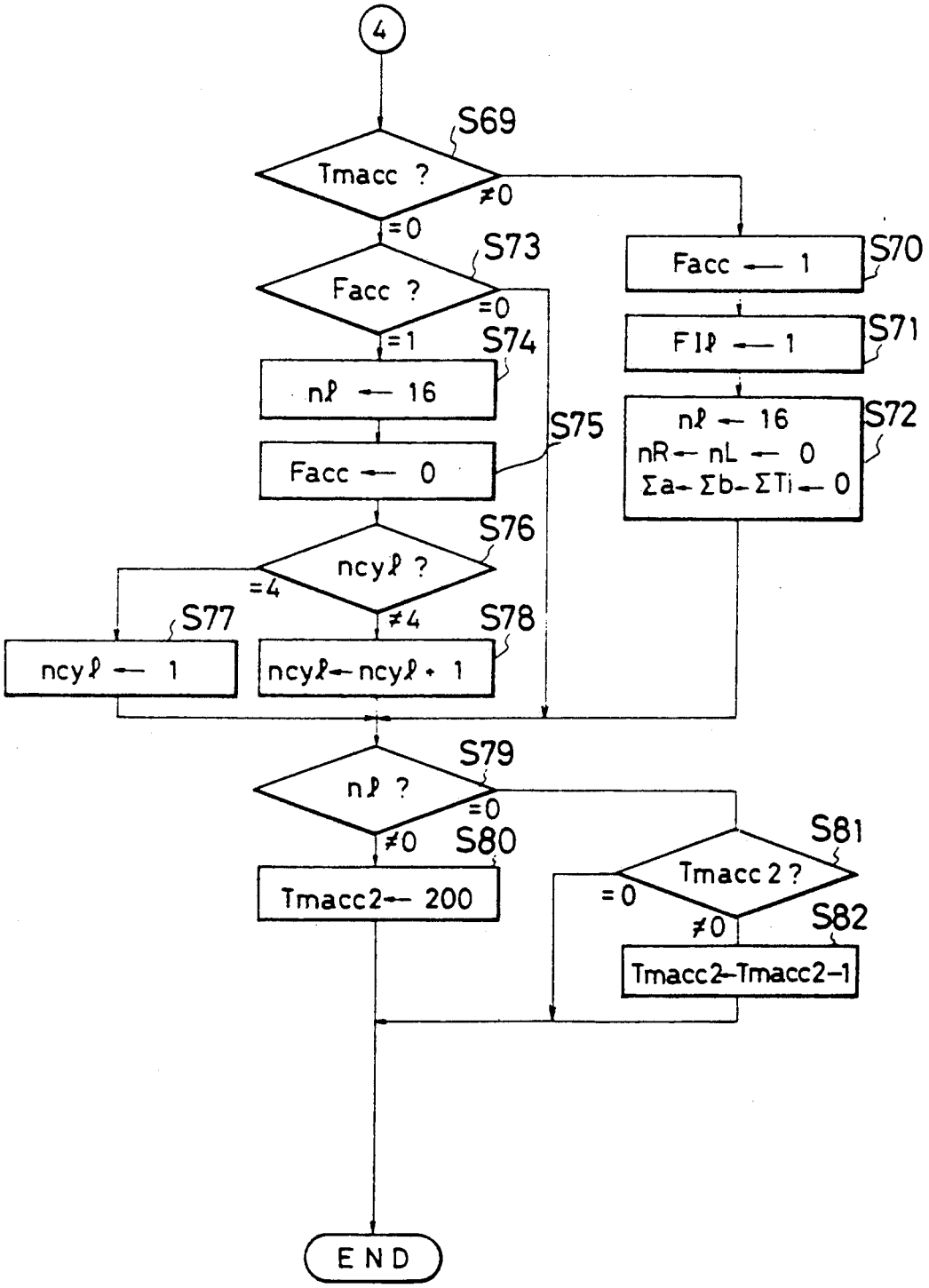

The routine shown in the flow chart of FIG. 4 is a fuel injection quantity-calculating routine which is executed at every 10 ms. At first, at step 61, the opening degree TVO of the throttle valve 4 detected by the throttle sensor 17, the engine revolution number N calculated based on the detection signal from the crank angle sensor 14, the sucked air flow quantity Q detected by the air flow meter 13, and the like are received.

At next step 62, a basic fuel injection quantity (basis fuel supply quantity) Tp common to the respective cylinders [←K×(Q+ΔQ)Q/N; K is constant)] is calculated based on the engine revolution number N and sucked air flow quantity Q received at step 61 and the air leakage correction valve (first correction valve) ΔQ set in the routine shown in the flow chart of FIG. 8 described hereinafter. Incidentally, the air leakage correction valve ΔQ is used for correcting the detected value Q of the sucked air flow quantity by a certain quantity to compensate the quantity of air leaking into the suction system of the engine downstream of the air flow meter 13, which is not detected by the air flow meter 13.

At step 63, it is judged whether or not the change ratio ΔTVO of the opening degree per unit time is substantially equal to zero.

When the change ratio ΔTVO of the opening degree of the throttle valve 4 is substantially equal to zero, it is judged at step 64 whether or not the change ratio ΔN of the engine revolution number N is substantially equal to zero.

When it is judged at step 64 that the change ratio ΔN is substantially equal to zero, the engine 1 is regarded as being in the state of the stationary driving, and the routine goes into step 65, When at least one of ΔTVO and ΔN is not substantially equal to zero but varies, the engine 1 is regarded as being in the state of the transient driving, and the routine goes into step 65.

At step 67, a predetermined time (300) is set at a timer Tmacc for measuring the time elapsing from the point of the transition to the stationary driving from the transient driving. When the transient driving shifts to the stationary driving, at step 65, it is judged whether or not the timer Tmacc is at zero, and when the timer Tmacc is not at zero, the routine goes into step 66 and the value of the timer Tmacc is counted down by 1.

Accordingly, the timer Tmacc is at zero when the predetermined time, set by the predetermined value set at step 67 and the execution frequency of the present routine, elapses from the point when the stationary driving of the engine 1 judged based on ΔTVO and ΔN. Even if the stationary driving of the engine 1 is judged based on ΔTVO and ΔN, there are influences of the variation of the air-fuel ratio until the timer Tmacc becomes at zero. Therefore, only during the stable stationary driving after the passage of the predetermined time from the transient driving where the timer Tmacc is at zero, the Learning of F/I is carried out (step 69).

At next step 68, the effective injection quantity Te common to the respective cylinders for the normal injection control and the effective injection quantity Tedmy for the learning (error detection) of the fuel injection valve 6 are calculated according to the following equations:

$$Te \leftarrow 2 \times Tp \times LMD \times COEF \times KBLRC \times PREF$$

and $$Tedmy \leftarrow 2 \times Tp \times (LMD \times 1.16) \times COEF \times KBLRC \times PREF$$

In the above equations, Tp represents the basic fuel injection quantity calculated at step 62 of the present routine, LMD represents the air-fuel ratio feed back correction coefficient calculated according to the routine shown in the flow chart of FIG. 3, KBLRC represents the air-fuel ratio learning correction coefficient learned for each driving condition in the routine shown in FIG. 3, PREF represents a fuel supply system correction value (second correction value) set as described hereinafter according to the routine shown in the flow chart of FIG. B, which is used for compensating an abnormal pressure when the pressure of the fuel supplied under pressure to the fuel injection valve 6 is changed from the initial valve by a disorder of the fuel pump F/P or the pressure regulator PR, and COEF represents various correction coefficients set based on the engine driving state represented mainly by the cooling water temperature Tw detected by the water temperature sensor 15.

The calculation equation for the effective injection quantity Tedmy for the learning of the fuel injection valve (F/I) 6 is different from the calculation equation for the normal effective injection quantity Te in that the air-fuel ratio feedback correction coefficient LMD is multiplied by the predetermined value Z (1.16), and by applying this effective injection quantity Tedmy only to one specific cylinder during the period of the learning of the fuel injection valve 6 where the above-mentioned F/I learning flag FII is at zero, the fuel injection quantity Ti of said one cylinder is forcibly changed, and by inspecting the change of the air-fuel ratio feedback correction coefficient LMD where influences of this forcible change appear, an arror of the supply characteristics of the fuel injection valve 6 of the cylinder to which the effective injection quantity Tedmy is applied is detected.

At step 69, it is judged whether the timer Tmacc is at zero. When the timer Tmacc is not at zero, the engine 1 is in the transient driving state, or is not in the stable stationary driving state, and, therefore, the routine goes into step 70.

At step 70, 1 is set at a transient falg Facc for judging the transient driving of the engine 1. At next step 71, 1 is set at the F/I learning flag FII to inhibit the learning of F/I.

At step 72 the predetermined value of 16 is set at the normal learning counter nl, and simultaneously nR and nL for counting the frequencies of the rich/lean reversals are reset at zero and Σa and Σb for the integration of the peak values of the air-fuel ratio feedback correction coefficient LMD and ΣTi for the integration of the fuel integration quantity Ti are reset at zero.

On the other hand, when it is judged at step 69 that the timer Tmacc is at zero, the routine goes into step 73 and the judgement of the transient flag Facc is carried out. Since 1 is set at the transient flag Facc when Tmacc is not at zero, when Tmacc is first at zero, it is judged at this step 73 that Facc is at 1 and the routine goes into step 74.

At step 74, the predetermined value of 16 is set at the normal learning counter nl again, and at next step 75, zero is set at the transient flag Facc.

Then, at next step 76, it is judged whether or not ncyl indicating the number of the cylinder where the learning is carried out is at 4 . When ncyl is at 4, 1 is set at ncyl at step 77 so that the learning is carried out with respect to the fuel injection valve 6 of the cylinder #1. When ncyl is not at 4, ncyl is counted up by 1 at step 78, so that the learning is carried out with respect to any of the cylinders #2, #3 and #4. Accordingly, the cylinder where the learning of the fuel injection valve 6 is carried out is changed over at every initial detection of Tmacc=zero, that is, at every initial detection of the stable stationary driving.

At next step 79, it is judged whether or not the normal learning counter nl is at zero. When it is judged that the normal learning counter nl is not at zero, the predetermined value of 200 is set at the timer Tmacc2 at step 80. When it is judged that the normal learning counter nl is at zero, it is judged at step 81 whether or not the timer Tmacc is at zero. When the timer Tmacc is at zero, the routine goes into step 82 and the timer Tmacc is counted down by 1.

While the normal learning counter nl is counted down to zero from the predetermined value, data of Σa and Σb and the like are collected in the normal duel control state based on the effective injection quantity Te, and then only the fuel injection valve 6 of the specific cylinder is controlled based on the above-mentioned effective injection quantity Tedmy and data of Σa and Σb and the like are collected during the learning of F/I in this cylinder. However, since the air-fuel ratio feedback correction coefficient LMD is not stable in the initial state where use of the effective injection quantity Tedmy is started, collection of data of Σa and Σb and the like in the state of the learning of F/I during the time measured by the timer Tmacc2 is inhibited (see FIG. 10).

Figures 1, 5:
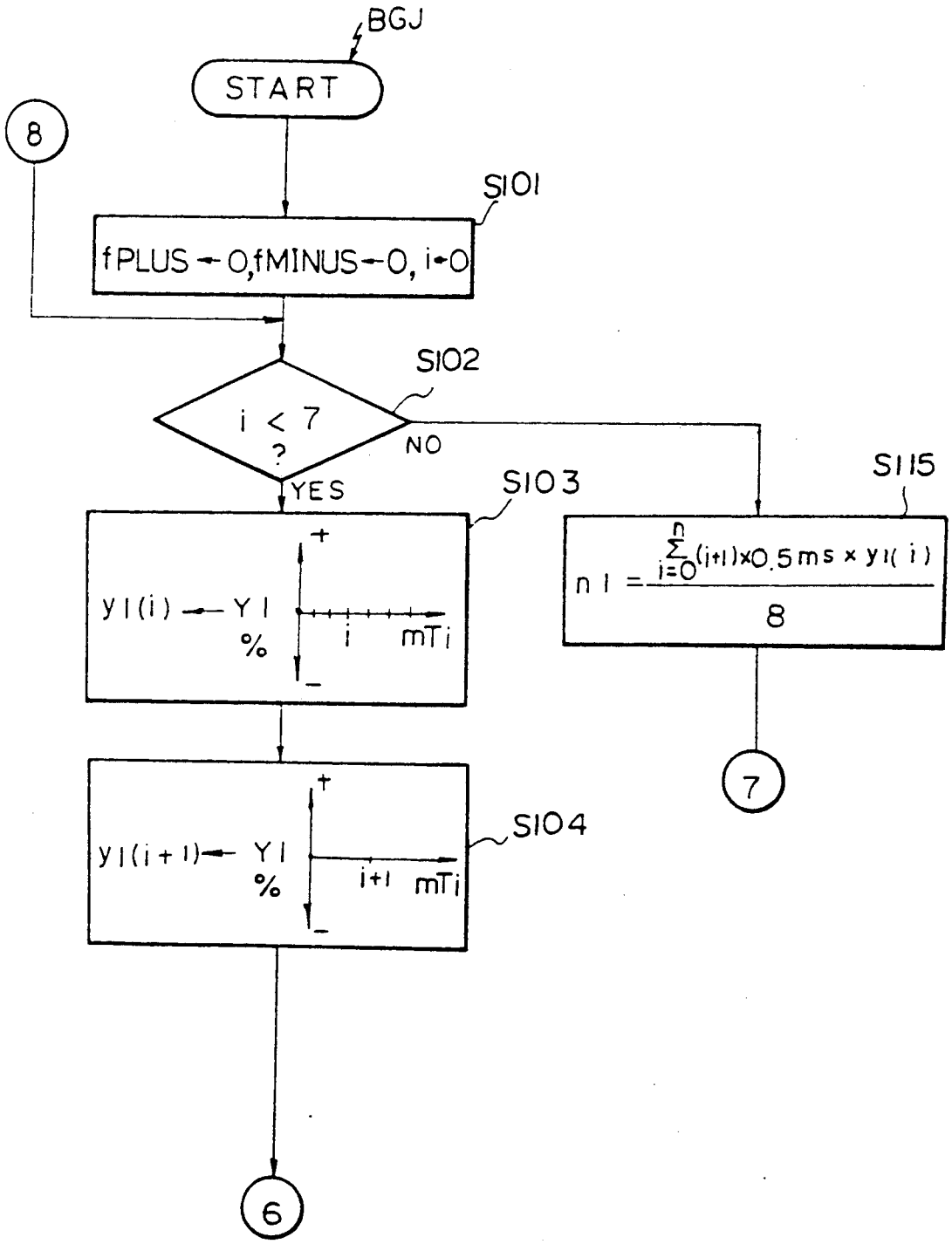
Figures 2, 5:
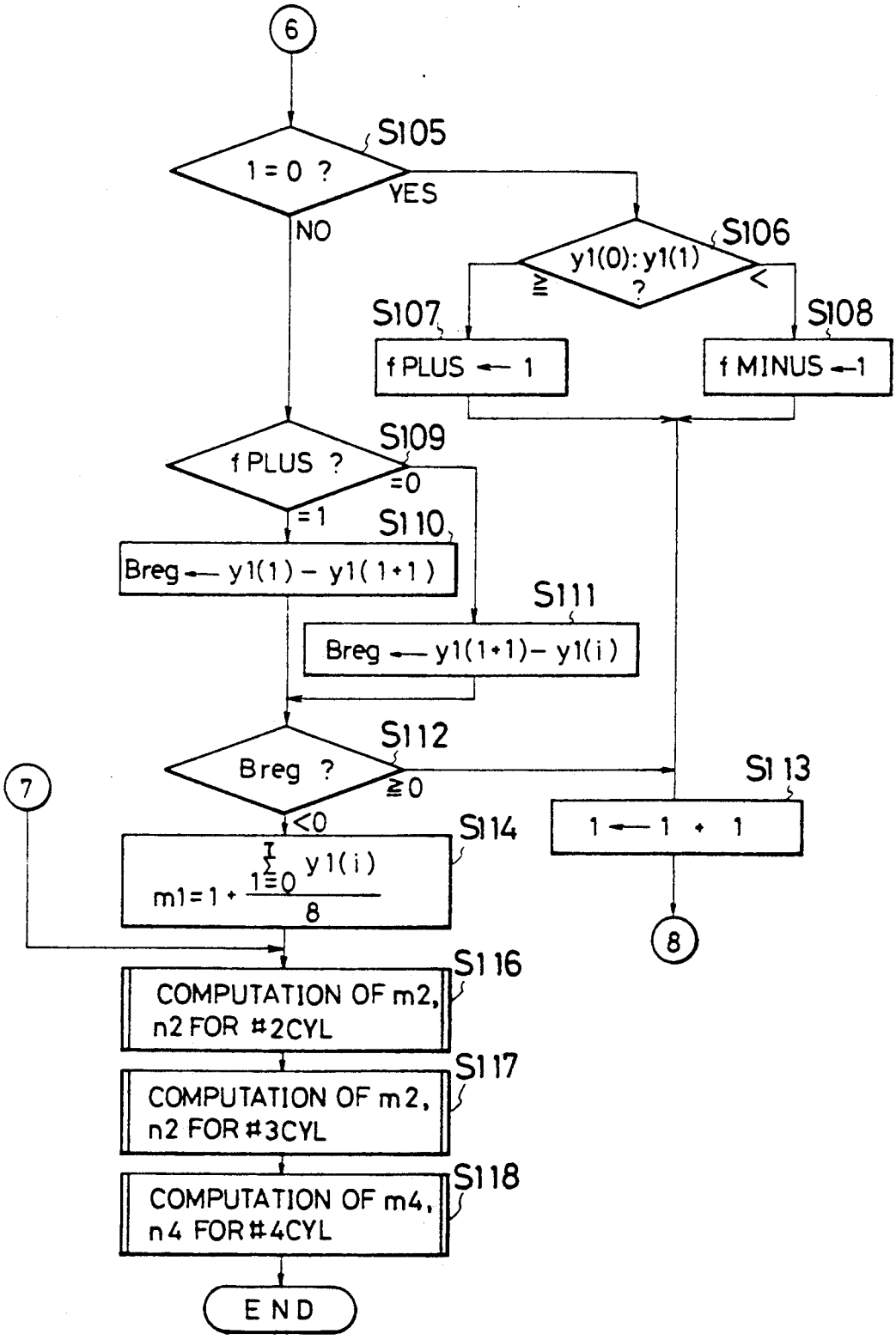

The learning of the fuel injection quantity for each cylinder, executed according to the routine shown in the flow chart of FIG. 5, will now be described.

This routine is practiced as the background job (BGL). At first, at step 101, flags fplus and fminus for judging whether or not the absolute values of error rates Y1 through Y4 of the supply characteristics of the fuel injection valves 6 stored independently for respective cylinders in correspondence to the fuel injection quantity mTi (see steps 53 through 59) are decreased one at a time relative to the increasing change of the fuel injection quantity Ti are reset at zero, and an address i designating the map addresses of the error rates Y1 through Y4 is reset at zero.

At next step 102, it is judged whether or not the address i is smaller than 7, and in case of $i<7$, the routine goes into step 103.

At step 103, data stored at the address i of the lattice of the fuel injection quantity mTi are read out from the map where the error rate Y1 obtained at the learning of the fuel injection valve 6 of the cylinder #1 is stored in correspondence to the fuel injection quantity mTi, and the valve of the data is set at y1 (i).

At step 104, data stored at the address i+1 subsequent to the address i used at step 103 in the map of Y1 are read out, and the value of the data is set at y1 (i+1).

At next step 105, it is judged whether or not the address i is at zero. When the address i is at zero at the initial progress to step 102 from step 101, the routine goes into step 106. At step 106, the error rate y1 (0) of the fuel injection valve 6 of the cylinder #1 at the address i (i=0) obtained at step 102 is compared with y1 (1) at the next address i (i=1).

When y1 (0) is larger, the routine goes into step 107, and 1 is set at the flag fplus reset at zero at step 101. When y1 (1) is larger, 1 is set at the flag fminus reset at zero at step 101.

The factor causing the error Y1 is judged, as described hereinafter, by judging whether or not the manner of the change of y1 represented by the flags fplus and fminus set as mentioned above continues when the number of the address i is increased, and a corresponding correction item is set according to the result of the judgement.

At next step 113, the number of the address i is increased by 1. Therefore, in the case where the routine goes into step 106 in the state where the address i at zero, 1 is set at the address i at this step 113.

After the number of the address i is increased by 1 at step 113, the routine returns to step 102, and since the number of the address 1 is smaller than 7, the computing processing at steps 103 and 104 is repeated. When it is judged at step 105 that the address i is not at zero, the routine goes into step 109.

At step 109, it is judged whether the flag fplus set when the address i is at zero is at 1 or zero, and when the flag fplus is at 1, the routine goes into step 110 and [y1 (i)−y1 (i+1)] is set at Breg. When the flag fplus is at 0 and the flag fminus is at 1, the routine goes into step 111 and [y1 (i+1)−y1 (i)] is set at Breg.

Then, at step 112, it is judged whether the above-mentioned Breg is positive or negative, and when Breg is positive, the routine goes into step 113 and the number of the address i is increased by 1. Then, computing processing at steps 102 through 104 is repeated.

Namely, when the absolute value of the error rate y1 (i) continually decreases relative to the increasing change of the fuel injection quantity Ti, for example, if the flag fplus is at 1, [y1 (i)−y1 (i+1)] should always be positive, and if the flag fminus is at 1, [y1 (i+1)−y1 (i)] should always be positive. Accordingly, if it is judged at step 112 that Breg is positive, this indicates that the absolute value of the error rate y1 (i) continuously decreases relative to the increasing change of the fuel injection quantity Ti.

When Breg is positive, the number of the address i is increased by 1 at step 113, and the routine returns to step 102, and it is confirmed that Breg is positive until the address i is increased to 7.

When the continuous decrease of the absolute value of the error rate y1 (i) according to the increasing change of the fuel injection quantity Ti is continuously judged until the address i is increased to 7, the routine goes into step 115 from step 102.

At step 115, a correction component n1 for correcting the correction component Ts by the battery voltage for calculating the fuel injection quantity Ti, only by a certain quantity for the cylinder #1, is calculated according to the following equation:

$$n1 = \frac{\sum_{i=0}^{7} (i+1) \times 0.5\ \text{ms} \times y1\ (i)}{8}$$

The fuel injection quantity Ti is set as the opening time (ms) of the fuel injection valve 6, and in the map of error rates Yϕ and Y1 through 4, the fuel injection quantity Ti is 0.5 ms when the address i is at zero and the fuel injection quantity Ti is increased by 0.5 ms every time the number of the address i is increased by 1. Accordingly, (i+1)×0.5 ms is the fuel injection quantity Ti corresponding to the address i, and corresponds to the error rate y1 (i) in the fuel injection valve 6 of the cylinder #1, which corresponds to this fuel injection quantity Ti.

When the fuel for the cylinder #1 is corrected only by a certain quantity, if the fuel injecting quantity Ti is large, the effect by this correction is not manifested, and if the fuel injection quantity Ti is small, this correction effect is manifested. Accordingly, if the correction by a certain quantity is excessive or insufficient, the smaller is the fuel injection quantity, the larger is the error of the fuel control. In the calculation of the normal fuel injection quantity, the correction component Ts is added to the effective injection quantity Te so as to correct the change of the effective opening time (the delay of the opening or closing of the valve) of the fuel injection valve 6 by the change of the voltage of the battery as the driving power source, but if this correction component Ts, that is, the certain quantity, is made excessive or insufficient by deterioration of the fuel injection valve 6, as pointed out hereinbefore, the error rate of the fuel supply is large as the fuel injection quantity Ti is small, and therefore, when the absolute value of the error rate y1 (i) continuously decreases relative to the increasing change of the fuel injection quantity Ti, it is considered that this decrease is due to the excess or deficiency of the correction component Ts.

Hereupon, the value of [error rate y1 (i)×fuel injection quantity Ti] corresponds to the above-mentioned excess or deficiency of the correction component Ts, and in the above-mentioned calculation equation for n1, excesses deficiencies of Ts calculated at the respective addresses i are leveled.

On the other hand, when it is judged at step 112 that Breg is negative, this indicates that the error rate y1 (i) changes in the direction of the change caused when the address i is at zero, and it cannot be considered that the absolute value of the error rate y1 (i) continuously decreases. Accordingly, the routine goes into step 114.

At step 114, the correction coefficient m1 for correcting the effective injection quantity Te (basic fuel injection quantity Tp) at a certain ratio in calculating the fuel injection quantity Ti for the cylinder #1 is calculated according to the following equation:

$$m1 = 1 + \frac{\sum_{i=0}^{7} y1(i)}{8}$$

When the absolute value of the error rate y1 (i) does not decrease continuously relative to the increasing change of the fuel injection quantity but is substantially constant, this error rate can be cancelled by correcting the effective fuel injection quantity Te (basic fuel injection quantity Tp) at a certain ratio.

Figure 11:
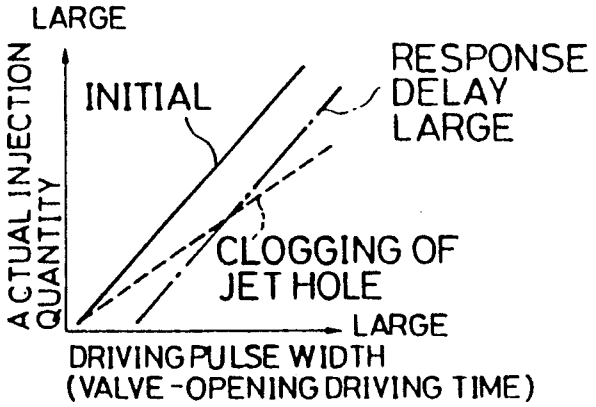
FIGS. 11 through 13 are graphs showing the characteristics of deviations of the air-fuel ratio by respective factors.

Namely, for example, if one of many injection holes of the fuel injection valve 6 is clogged, the error rate y1 (i) is substantially constant to the increase of the fuel injection quantity Ti, and the actual injection quantity is changed relatively to the fuel injection quantity Ti (valve-opening time) as shown in FIG. 11. Accordingly, in order to compensate the error of the supply characteristics by this clogging of the injection hole, the effective injection quantity Te is multiplied by the correction coefficient, so that the inclination of the actual injection quantity to the fuel injection quantity Ti (pulse width) in FIG. 11 is apparently corrected.

Incidentally, the error rate y1 (i) is a value indicating that although the effective injection quantity Te of the cylinder #1 is multiplied by the predetermined value z, the actually obtained result is equal to the result obtained by multiplying the effective injection quantity Te by [predetermined value z−error rate y1 (i)]. Accordingly, in order to actually obtain the desired fuel quantity, the effective injection quantity Te is multiplied by [1+error rate y1 (i)]. Namely, the correction coefficient m1 for correcting the effective ingredient quantity Te (basic fuel injection quantity Tp) of the cylinder #1 is set by adding 1 to the mean value of y1 (i) at respective addresses i.

After the correction component n1 for correcting the fuel injection quantity Ti of the cylinder #1 by a certain quantity and the correction coefficient m1 for correcting the basic fuel injection quantity Tp at a certain rate are learned based on the error rate Y1 of the supply characteristics determined at the learning of the fuel injection valve 6 of the cylinder #1, correction items n2 through n4 and m2 through m4 for the cylinders #2, #3 and #4 are similarly learned and set at steps 116 through 118 as at steps 101 through 114.

Figures 1, 6:
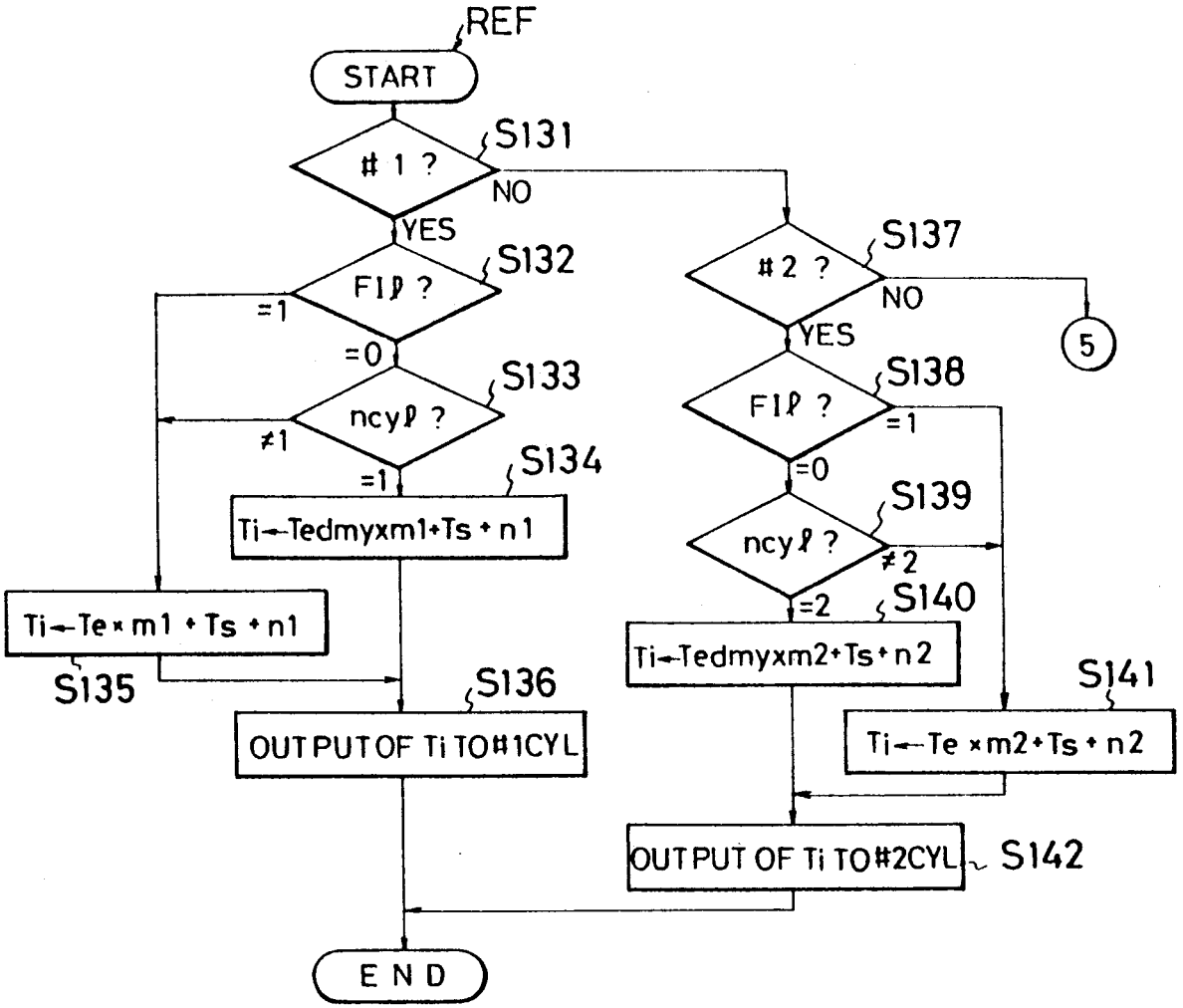
Figures 2, 6:
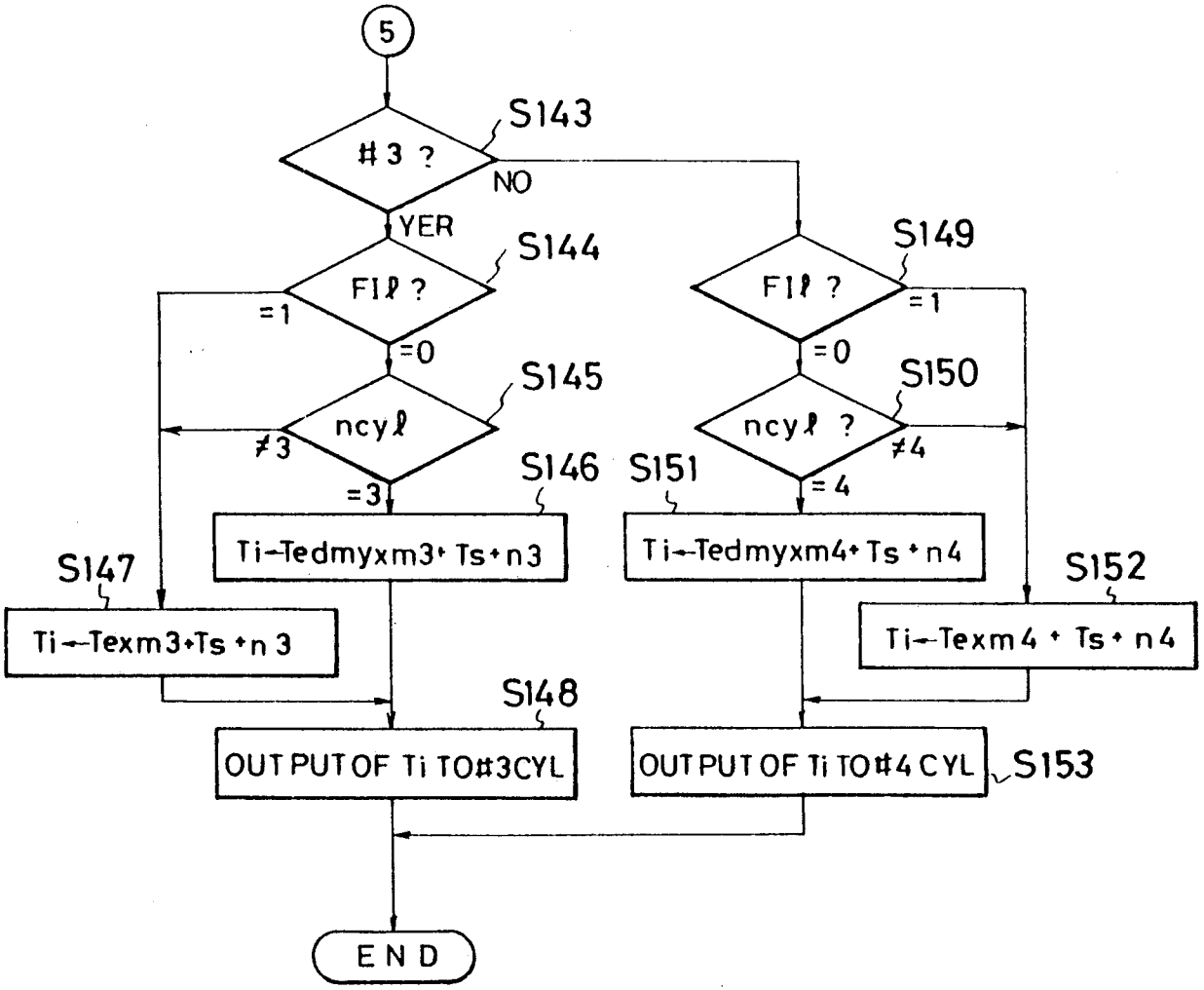

The thus learned and set correction items n1 through n4 and m1 through m4 (correction values for the respective cylinders) are used for the calculation of the fuel injection quantity Ti for each cylinder in the fuel supply control routine shown in the flow chart of FIG. 6, and the injection supply of the fuel to the respective cylinders is controlled based on the fuel injection quantities Ti learned and set according to the error rates Y1 through Y4 of the supply characteristics of the fuel injection valves 6 of the respective cylinders.

The routine shown in the flow chart of FIG. 6 is executed every time a reference angle signal REF is emitted at every crank angle of 180° in case of a 4-cylinder engine from the crank angle sensor 14, and every time the reference angle signal REF is emitted, the supply of fuel to each cylinder is started synchronously with the suction stroke of each cylinder.

At first, at step 31, it is judged whether or not the present reference angle signal REF corresponds to the start of the supply of the fuel to the cylinder #1, and when the signal REF is for the cylinder #4, the routine goes into step 132.

At step 132, the F/I learning flag FII is checked, and when the F/I learning flag FII is at 1 and the time is not correct for carrying out the learning of the fuel injection valve 6, the routine goes into step 135, and the fuel injection quantity (fuel supply quantity) Ti is calculated from the effective fuel injection quantity Te (=2×Tp×LMD×COEF×KBLRC×PRFP) common to the respective cylinders for the normal injection, computed at step 68, the correction items m1 and n1 learned and set for the cylinder #1 and the correction component Ts set based on the battery voltage commonly to all the cylinders according to the following equation:

$$Ti \leftarrow Te \times m1 + Ts + n1$$

On the other hand, when it is judged at step 132 that the F/I learning flag FII is at zero, this indicates that at this time, the error of the supply characteristics of the fuel injection valve 6 of one specific cylinder should be detected by using the effective injection quantity Tedmy [2×Tp×(LMD×1.16)×COEF×KBLRC×PREF] for the calculation of the fuel injection quantity Ti of said one specific cylinder. Accordingly, the routine goes into step 133, and it is judged whether or not ncyl is at 1, and it is judged whether or not the fuel injection valve 6 of the cylinder #1 should be learned at this turn by the present F/I learning.

When it is judged at this step that ncyl is at 1, the above-mentioned effective injection quantity Tedmy is used for the calculation of the fuel injection quantity Ti of the cylinder #1, whereby the air-fuel ratio (fuel quantity) of the first cylinder #1 is forcibly shifted, and it is inspected whether or not this result is manifested in the change of the air-fuel ratio feedback correction coefficient, as expected. Accordingly, at step 134 the fuel injection quantity of the cylinder #1 is calculated by the effective injection quantity Tedmy according to the following equation:

$$Ti \leftarrow Tedmy \times m1 + Ts + N1$$

During the learning of F/I or if the cylinder #1 is designated by this learning, the fuel injection quantity Ti is thus calculated at step 134 or at step 135, and at step 136, a driving pulse signal having a pulse width corresponding to the calculated fuel injection quantity Ti is emitted to the fuel injection valve 6 of the cylinder #1 to effect the injection and supply of the fuel to the cylinder #1.

When it is judged at step 131 that the present reference angle signal REF does not correspond to the start of the injection of the fuel in the cylinder #1, the routine goes into step 137, and it is judged whether or not the present reference angle signal REF corresponds to the start of the injection of the fuel to the cylinder #2.

When the present reference angle signal REF corresponds to the start of the injection of the fuel to the cylinder #2, as in case of the above-mentioned start of the injection to the cylinder #1, during the learning of F/I or if the cylinder #2 is designated by the learning (step 138 or 139), the fuel injection quantity Ti for the cylinder #2 is calculated at step 140 or 141, and at step 142, a driving pulse signal having a pulse width corresponding to the calculated fuel injection quantity Ti is emitted to the fuel injection valve of the cylinder #2.

When it is judged at step 137 that the present reference angle signal REF does not correspond to the start of the injection to the cylinder #2, the routine goes into step 143, and at this step it is judged whether or not the reference angle signal REF corresponds to the start of the injection to the cylinder #3.

When it is judged that the present reference angle signal REF corresponds to the start of the injection to the cylinder #3, in the same manner as described above, during the learning of F/I or if the cylinder #3 is designated by this learning (step 144 or 145), the fuel injection quantity Ti for the cylinder #3 is calculated at step 146 or step 147, and at step 148, a driving pulse signal having a pulse signal corresponding to the fuel injection quantity Ti is emitted to the fuel injection valve 6 of the cylinder #3.

When it is judged at step 143 that the reference angle signal REF does not correspond to the start of the injection to the cylinder #3, since the present start of the injection is for the remaining cylinder #4, during the learning of F/I or if the cylinder #4 is designated by this learning (step 149 or 150), the fuel injection quantity Ti for the cylinder #4 is similarly calculated at step 151 or step 153, and a driving pulse signal having a pulse width corresponding to the calculated fuel injection quantity Ti is emitted to the fuel injection valve 6 of the cylinder #4.

As is apparent from the foregoing description, the error rates Y1 through Y4 of the supply characteristics to the fuel injection valve 6 of the respective cylinders are independently detected, the correction items n1 through n4 and m1 through m4 (correction values for the respective cylinders) are set so that these error rates Y1 through Y4 can be cancelled, and the fuel injection quantities Ti for the respective cylinders are controlled based on the fuel injection quantities Ti matched to the supply error rates Y1 through Y4 for the respective cylinders. Accordingly, even if there are dispersions of the supply charateristics among the fuel injection valves 6 of the respective cylinders, the air-fuel ratio of each cylinder can be brought close to the target air-fuel ratio, and hence, worsening of the exhaust gas or occurrence of misfire in a specific cylinder, due to dispersions of the air-fuel ratio among the cylinders, can be avoided.

Since the error rates Y of the supply characteristics of the fuel injection valves 6 of the respective cylinders are independently detected and the correction items m1 through m4 and n1 through n4 are independently learned and set for the respective cylinders based on these error rates Y, disorders of the fuel injection valves 6 of the respective cylinders can be independently diagnosed based on the detected error rates Y1 through Y4 or the correction items m1 through m4 and n1 through n4 matched to the error rates.

Figure 7:
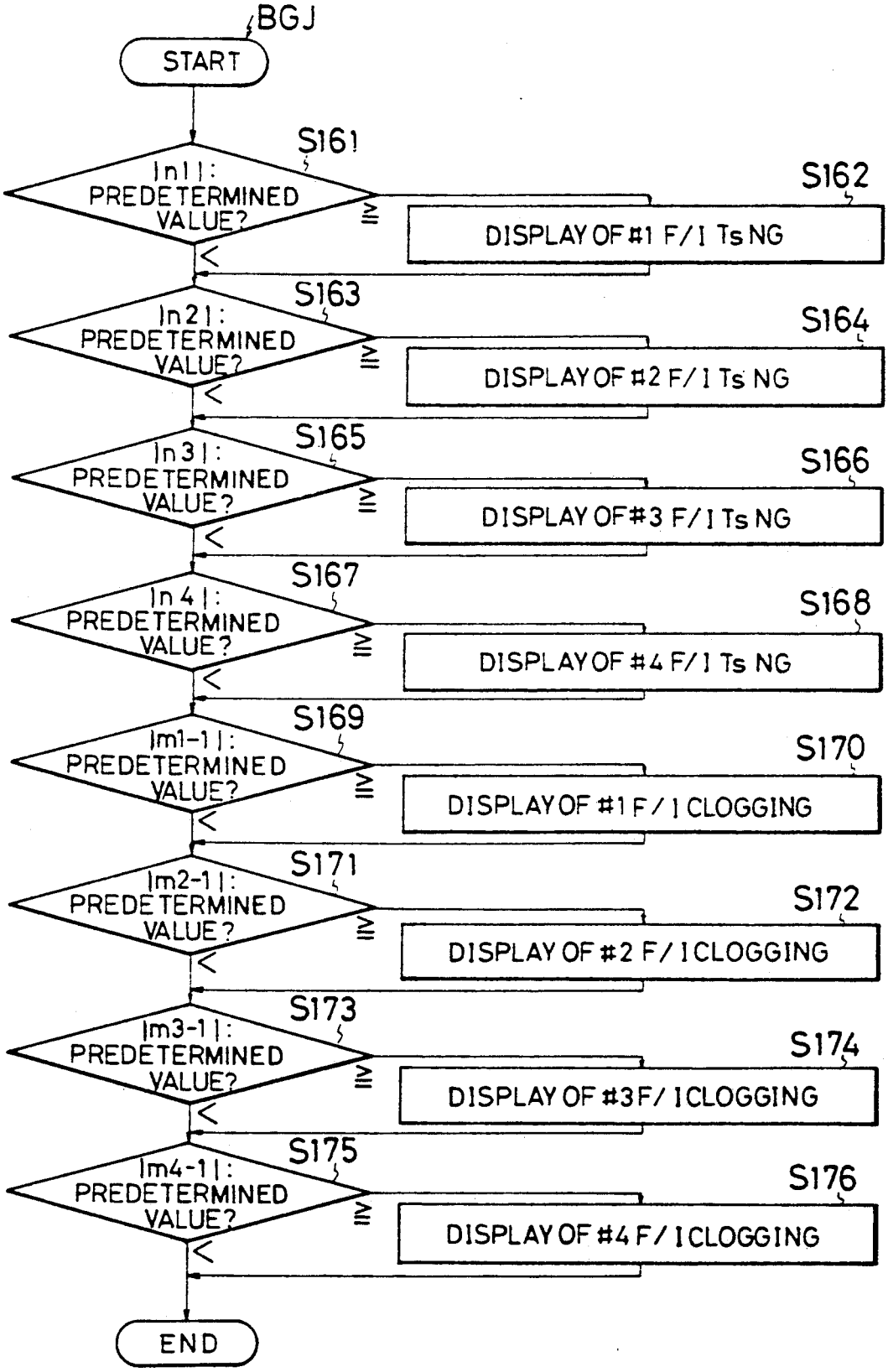

In the present embodiment, disorders of the fuel injection valves 6 of the respective cylinders are independently diagnosed based on the correction items m1 through m4 and n1 through n4 (correction values for the respective cylinders) according to the routine shown in the flow chart of FIG. 7.

The routine shown in the flow chart of FIG. 7 is executed as the background job (BJL). At first, at step 161, it is judged whether or not the absolute value of the correction component n-1 for correcting the battery voltage correction component Ts for the cylinder #1 is larger than the predetermined value.

When the absolute value of n1 is larger than the predetermined value, this indicates that in the fuel injection valve 6 of the cylinder #1, a substantially desired battery voltage correction (the correction of the delay of opening or closing of the valve) can be affected by Ts common to all of the cylinders in the initial state, but it becomes impossible to perform a desired fuel injection in the fuel injection valve 6 in the cylinder #1 unless Ts is greatly corrected (generally to the positive side). Accordingly, the routine goes into step 162, and it is displayed on a dashboard or the like of a vehicle that the battery voltage correction component Ts becomes inadequate (NG), whereby a driver is informed that deterioration with time is caused in the fuel injection valve 6 of the cylinder #1 and the characteristics of the delay of opening or closing of the valve are changed (see FIG. 11).

Similarly, it is judged whether or not the absolute values of the correction components N2, n3 and n4 of the cylinders #2, #3 and #4 are larger than the predetermined value (steps 163, 165 and 167), and when the absolute values of the correction components n2, n3 and n4 are larger than the predetermined values, it is displayed that the correction components Ts of the fuel injection valves 6 of the corresponding cylinders are inadequate (steps 164, 166 and 168).

Incidentally, instead of the above-mentioned construction where the absolute values of the correction components n1 through n4 are compared with the predetermined value, there can be adopted a construction in which (TiIDLE+n1, n2, n3 or n4)/TiIDLE (TiIDLE represents the injection quantity Ti at the idling) is calculated, when the value obtained by the calculation is smaller then 0.92 or larger than 1.45, it is judged that Ts of the corresponding cylinder is inadequate, and the correction component n1, n2, n3 or n4 is checked at two different levels in the increasing correction direction and the decreasing correction direction, respectively, to effect the diagnosis.

At step 169, it is judged whether or not the absolute value of the value obtained by subtracting the reference value of 1 from the correction coefficient m1 learned and set for correcting the effective injection quantity Te of the cylinder #1 is larger than the predetermined value.

For example, if clogging of injection holes is caused in the fuel injection valve 6 of the cylinder #1, even by increasing the fuel injection quantity of the cylinder #1 by the predetermined value (1.16 in the present embodiment), the fuel is not injected in an increased amount matched to the predetermined value z, and therefore m1 is set at a value exceeding 1, and with increase of the clogging degree, m1 becomes a more larger value (see FIG. 11). Accordingly, the value obtained by subtracting the reference value of 1 from m1 shows the correction degree, and hence, by comparing the absolute value of this value with the predetermined value z, the diagnosis of the fuel injection valve 6 of the cylinder #1 is performed.

When the absolute value of [m1 − 1] is larger than the predetermined value, the routine goes into step 170, and it is displayed, for example, on a dashboard or the like of a vehicle, as in case of the above-mentioned inadequate Ts, that clogging of injection holes is caused in the fuel injection valve 6 of the cylinder #1, whereby a driver is informed of this disorder.

In the fuel injection valve 6 of the cylinder #1, if the quantity of the injected fuel is larger than the initial quantity with respect to the pulse width of the driving pulse signal, m1 is learned and set at a value smaller than 1, and it sometimes happens that the absolute value of [m1 − 1] becomes larger than the above-mentioned predetermined value if the leakage becomes violent, but in the present embodiment, there is adopted a method in which clogging is displayed simply in the above-mentioned manner. Of course, there can be adopted a method in which it is judged whether m1 is an increasing correction exceeding 1 or a decreasing correction smaller than 1 and the display of the result of the diagnosis is changed over according to the result of the judgement.

Similarly, it is judged whether or not the absolute values of the values obtained by subtracting the reference value of 1 from the correction coefficients m2, m3 and m4 for the cylinders #2, #3 and #4 are larger than the predetermined value (steps 171, 173 and 175), and if these absolute values are larger than the predetermined value, it is displayed that clogging is caused in the fuel injection valves 6 of the corresponding cylinders.

In the routine shown in the flow chart of FIG. 7, the diagnosis of disorders is performed according to the levels of the correction items n1 through n4 and m1 through m4, but the diagnosis of disorders of the fuel injection valves 6 can be independently carried out for respective cylinders based on the levels of error rates Y stored in correspondence to the fuel injection quantities Ti of the respective cylinders according to the routine shown in the flow chart of FIG. 3. Namely, in the routine of the flow chart of FIG. 3, at step 47, when the air-fuel ratio feedback correction coefficient LMD is not changed even if the correction of forcibly deviating the air-fuel ratio is carried out in one specific cylinder by correcting the quantity of the fuel, it is judged that the fuel injection valve 6 of said specific cylinder is in the state where the control is impossible. However, when the absolute value of the error quantity Y obtained at step 44 is larger than a predetermined value (for example, 0.06) and the difference between the change of the air-fuel feedback correction coefficient LMD expected by the correction of the fuel quantity in one specific cylinder and the actual change of LMD is large, a disorder (NG) of the fuel injection valve 6 of said cylinder can be diagnosed (step 180).

Accordingly, if it is thus displayed with respect to each cylinder whether the error of the supply characteristics of the fuel injection valve 6 is due to the change of the delay of opening or closing of the valve by deterioration or due to the clogging of injection holes, it can be easily judged with respect to each cylinder whether the fuel injection valve 6 should be exchanged with new one or should be cleaned, and, therefore, the maintenance can be facilitated.

Figure 8:
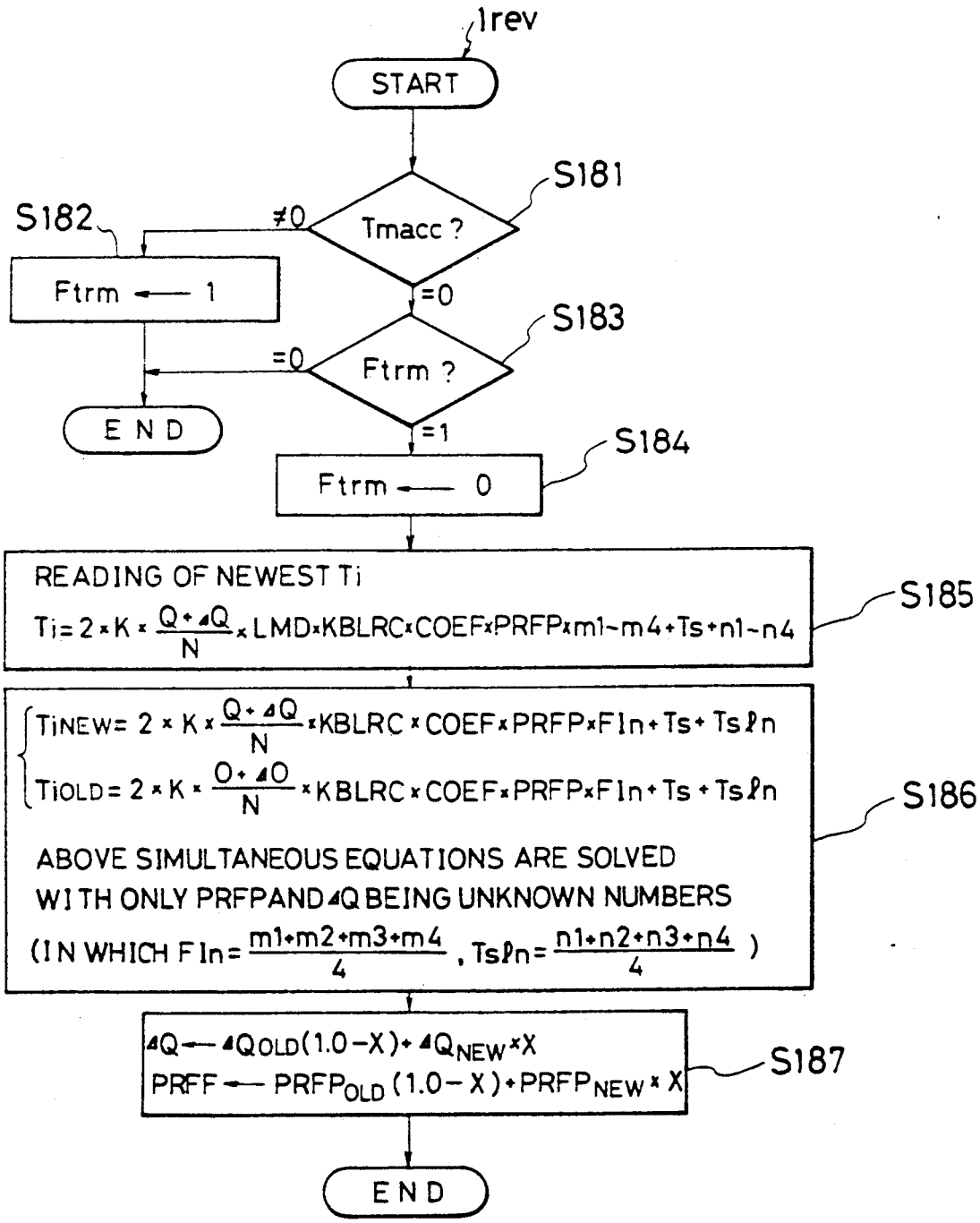

Setting and control of the air leakage correction value ΔQ (first correction value) to be added to the sucked air flow quantity Q in the calculation of the basic fuel injection quantity Tp and the fuel supply system correction value (second correction value) to be used as the correction coefficient for the basic fuel injection quantity Tp in the calculation of the effective injection quantity Te will not be described with reference to the routine shown in the flow chart of FIG. 8.

This routine is executed at every one revolution of the engine 1. At first at step 181, it is judged whether or not the timer Tmacc is at zero.

If it is judged at this step that the timer Tmacc is not at zero, the routine goes into step 182, and 1 is set at a flag Ftrm for the initial stationary state judgement and the present routine is ended.

On the other hand, when it is judged that the timer Tmacc is set at zero, the routine goes into step 183 and the initial stationary state judgement flag Ftrm is checked. Since 1 is set at the flag Ftrm when the timer Tmacc is not at zero, if the present judgement is the first judgement, the routine goes into next step 184 even though the flag Ftrm is at 1 at this step 183.

At step 184, zero is set at the flag Ftrm, and when it is judged at step 183 that the flag Ftrm is at zero, the present routine is ended. Accordingly, only when it is first judged that the timer Tmacc is at zero, processings at step 184 and subsequent steps are performed.

When zero is set at the flag Ftrm at step 184, the recently calculated fuel injection quantity Ti, together with calculation elements thereof, is read in at next step 185. Any of the correction values m1 through m4 and n1 through n4 for the respective cylinders can be used for this read fuel injection quantity Ti.

At next step 186, in each calculation of the equation of the fuel injection quantity Ti read at step 185 at the present operation and the calculation equation of the fuel injection quantity Ti read at step 185 at the previous operation (under conditions different from the conditions of the present operation), only the air leakage correction value ΔQ and the fuel supply system PRFP are used as unknown numbers, the air-fuel ratio feedback correction coefficient LMD is supposed to be the reference value of 1, and the mean values of the correction values m1 through m4 and n1 through n4 for the respective cylinders, that is, $FIn \leftarrow (m1+m2+m3+m4)/4$ and $Tsln \leftarrow (n1+n2+n3+n4)/4$, are substituted for the correction values for each cylinder, whereby two equations including only the air leakage correction value ΔQ and the fuel system correction value PRFP as unknown numbers are set up.

The air leakage correction value ΔQ and fuel supply system correction value PRFP satisfying commonly the above two equations as simultaneous equations, that is, matched to two different driving conditions, are determined.

Figure 12:
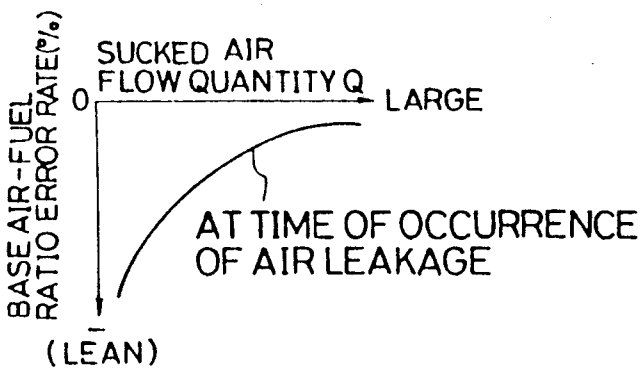
Figure 13:
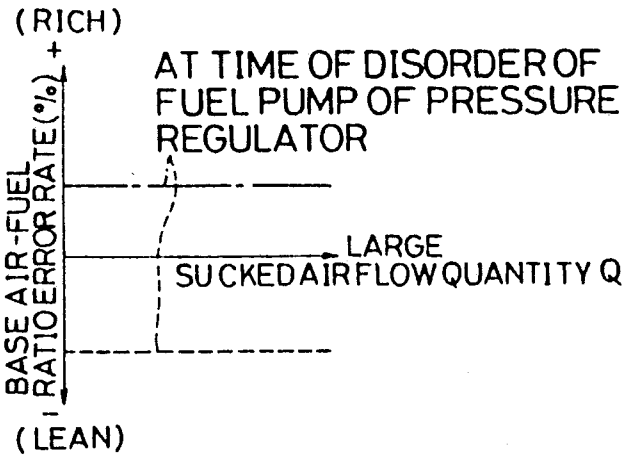

Accordingly, when the correction of the basic fuel injection quantity Tp is effected by the air-fuel ratio feedback correction coefficient LMD, this correction by the air-fuel ratio feedback correction coefficient LMD is borne by the air leakage correction value ΔQ and fuel supply system correction value PRFP, and the air leakage correction ΔQ and fuel supply system correction value PRFP are set so that the target air-fuel ratio, which has been obtained by the correction using the air-fuel ratio feedback correction coefficient LMD, can be obtained even without using the correction coefficient LMD. The tendency of the deviation of the air-fuel ratio at the time of occurrence of the air leakage is different from the tendency of the deviation of the air-fuel ratio at the time of occurrence of an abnormal fuel pressure as shown in FIGS. 12 and 13. Since one of them is an addition correction item to the sucked air flow quantity Q and the other is a multiplication correction item thereto, if simultaneous equations are set up under two different driving conditions as described hereinbefore, correction values coping with the air leakage and abnormal fuel pressure, respectively can be set irrespectively of the driving conditions. More specifically, if the air leakage occurs, the correction value ΔQ of a certain quantity is required irrespectively of the driving conditions, and if there appears an abnormal pressure, it becomes necessary to correct the basic fuel injection quantity at a certain ratio. Accordingly, if simultaneous equations are set up under different driving conditions, the correction values ΔQ and PRFP satisfying these correction requirements can be set.

If an arrangement is made so that the calculation equation of the fuel injection quantity for determining the air leakage correction value ΔQ and the fuel supply system correction value PRFP is read in only at the initial detection of the stationary driving state, setting-up of simultaneous equations under almost equal driving conditions can be avoided.

At next step 187, weighted mean values of the air leakage current value ΔQ and fuel supply system correction value PRFP obtained by solving the simultaneous equations at step 186 of the present operation and these values adopted at the precedent operation are set as final values to be used for the calculation of the fuel injection quantity Ti.

It is preferred that the weighted mean values of the air leakage correction values ΔQ and the fuel supply system correction values PRFP be calculated, for example, according to equations described below, and that the weight (weight applied to the present data) X used for the calculation be relatively small so that the renewal of the air leakage correction value ΔQ and fuel supply system correction value PRFP is slowly effected:

$$\Delta Q \leftarrow \Delta Qold(1.0-X)+\Delta Qnew \cdot X$$

and $$PRFP \leftarrow PRFPold(1.0-X)+PRFPnew \cdot X$$

The reasons are as follows. Namely, if the air leakage correction value ΔQ and fuel supply system correction value PRFP follow the change of the air-fuel ratio correction coefficient LMD with good response characteristics, the chance of learning of the learning correction coefficient KBLRC is lost, and if the correction values for obtaining the target air-fuel ratio vary according to changes of the sucked air flow quantity Q and the like, the above-mentioned air leakage correction value ΔQ and fuel supply system correction value PRFP greatly change and the control stability is lost. Moreover, since these correction values are not used only for the intended corrections, the precision of the diagnosis based on these correction values is reduced.

If the air leakage correction value ΔQ and fuel supply system correction value PRFP are learned and set in the above-mentioned preferable manner, even when leaking air that cannot be detected by the air flow meter 13 is present, this can be compensated by adding a certain amount for the correction. Furthermore, if the fuel is supplied under a pressure higher than the initial pressure to the fuel injection valve 6, for example, because of a disorder of the pressure regulator (see FIG. 13), the basic fuel injection quantity Tp is reduced at a predetermined ratio and a driving pulse coping with the increase of the pressure is given to the fuel injection valve 6, whereby the fuel can be supplied under the desired pressure.

Figure 9:
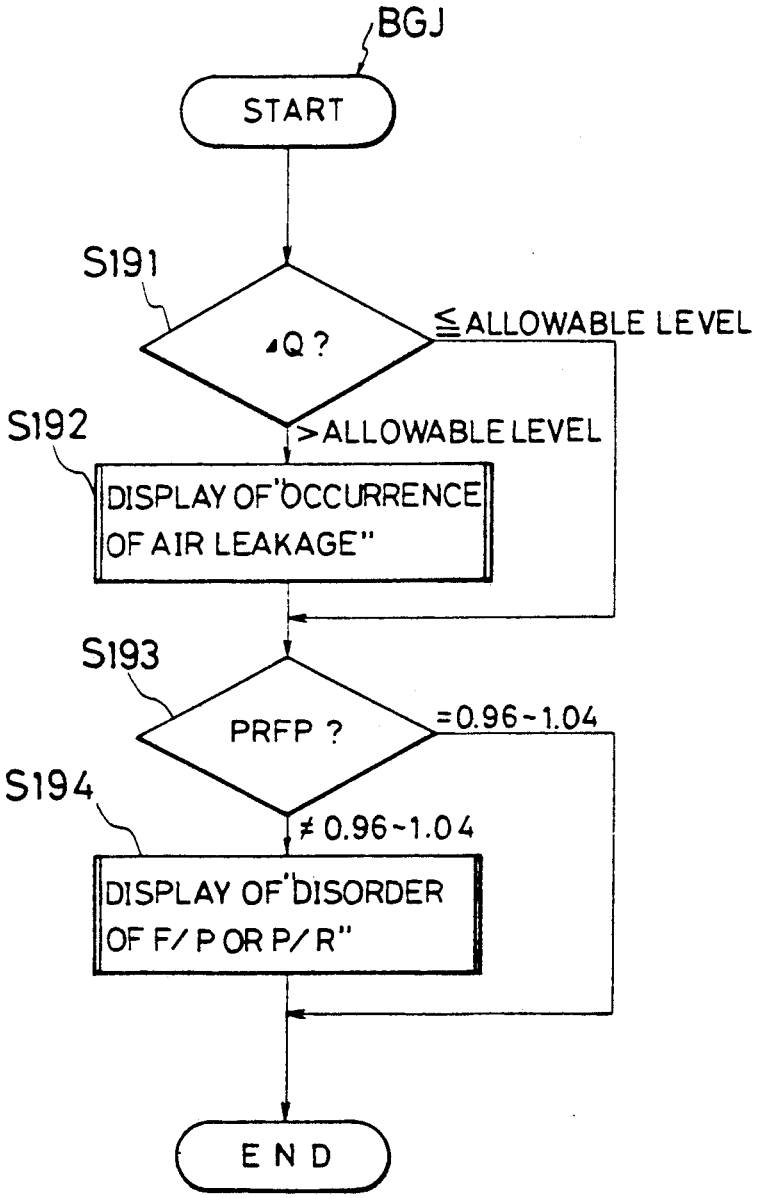
Figure 10:
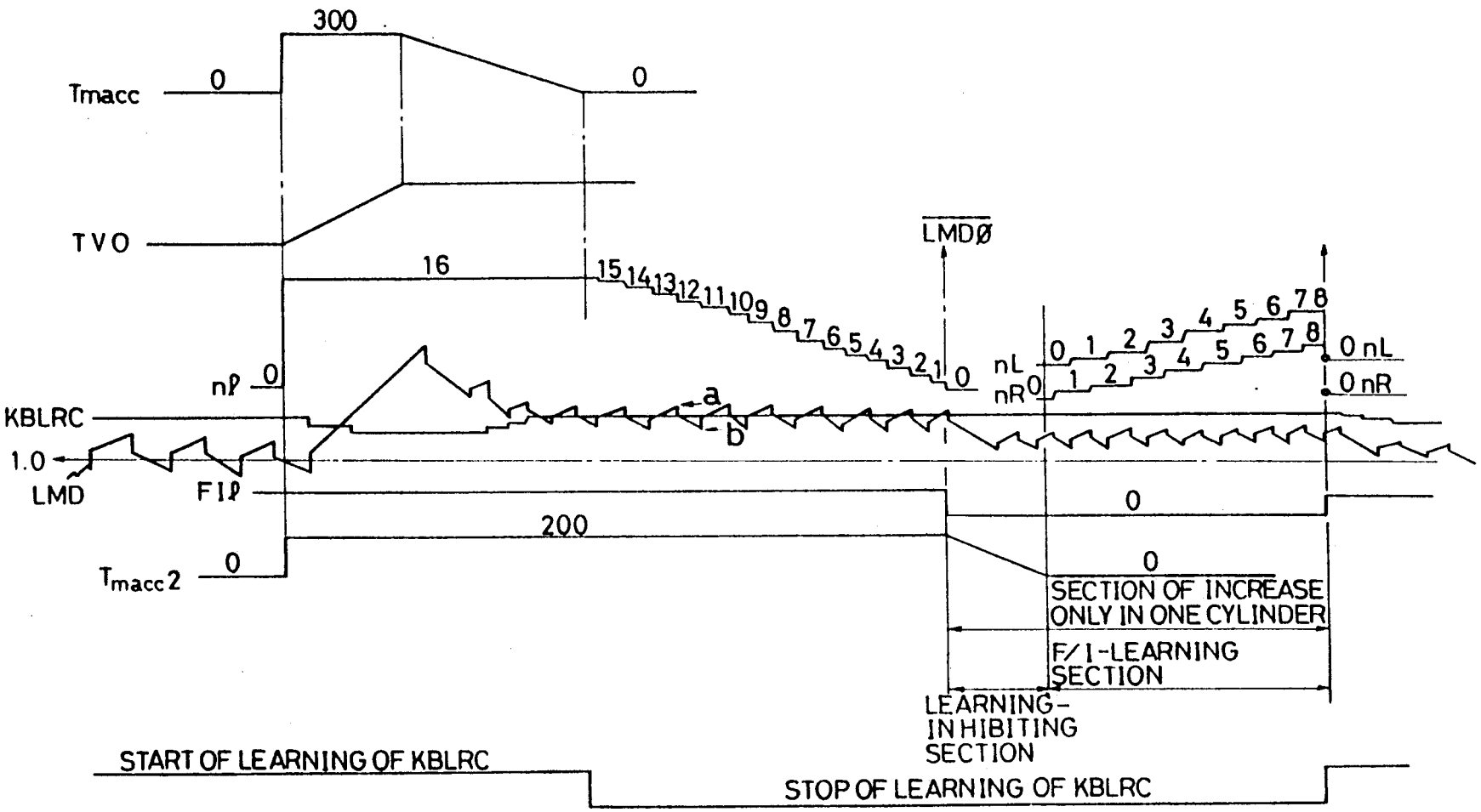
FIG. 10 is a time chart showing the control characteristics in the above-mentioned embodiment.

Accordingly, when the corrections by the air leakage correction value ΔQ and fuel supply system correction value PRFP increase, breakdowns of related fuel control systems can be diagnosed, and therefore, the self-diagnosis can be carried out, for example, according to the routine shown in the flow chart of FIG. 9.

The routine shown in the flow chart of FIG. 9 is executed as a background job (BGL). At first, at step 191, the air leakage correction value ΔQ is compared with a predetermined allowable level, and when a large correction value ΔQ exceeding the allowable level is set, the possibility of occurrence of the air leakage in the suction system of the engine 1 is very high. Accordingly, the routine goes into step 192, and occurrence of the air leakage is displayed, for example, on a dashboard of a vehicle.

At step 193, it is judged whether or not the fuel supply system correction value PRFP is within an allowable range (for example, from 0.96 to 1.04), and when a fuel supply system correction value PRFP exceeding the allowable range and a large correction is required, the possibility of occurrence of an abnormal pressure in the fuel supplied to the fuel injection valve 6 is very high. Therefore, the routine goes into step 194, and occurrence of a disorder of the fuel pump F/P or the pressure regulator PR is displayed, for example, on the dashboard of a vehicle.

As is apparent from the foregoing description, according to the present embodiment, dispersions of the fuel injection characteristics among the fuel injection valves 6 of respective cylinders are corrected and the target air-fuel ratio can be obtained in each cylinder. Furthermore, since the learning correction coefficient KBLRC learns and sets for each driving condition, such as the sucked air flow quantity Q, the correction value ΔQ corresponding to leaking air that is not detected by the air flow meter 13 and the correction value PRFP for correcting an abnormal fuel pressure are independently learned and set, for example, if the air leakage is caused, the correction value ΔQ corresponding to the air leakage is added under entire driving conditions even though occurrence of this air leakage is not detected under entire driving conditions. Moreover, minute required corrections differing according to driving conditions, which cannot be compensated for by the air leakage correction value ΔQ or the fuel supply system correction value PRFP, can be compensated for by the learning correction coefficient KBLRC, and generation of a large gap of the air-fuel ratio by the difference of the learning frequency or driving condition can be avoided.

Still further, since deviations of the air-fuel ratio are independently corrected according to respective factors causing the deviations, and disorders of the corresponding factors can be independently diagnosed, and by displaying the results of the diagnosis, the maintenance characteristics can be improved.

I claim:

1. A learning-correcting method in a fuel supply control system of an internal combustion engine, which system is constructed so that the fuel supply quantity is feedback-controlled based on a detected value of the sucked air flow quantity to bring the detected value of the air-fuel ratio close to the target air-fuel ratio and the fuel is independently supplied to respective cylinders by fuel supply means disposed for the respective cylinders, said method comprising:

forcibly correcting the fuel supply quantity independently for the respective cylinders, setting correction values for the respective cylinders, which are used for correcting the fuel supply quantity independently for the respective cylinders based on the difference between an expected value of the change of the air-fuel ratio, obtained by said forcible correction, the air-fuel ratio detecting means being an oxygen sensor for detecting oxygen concentration in the exhaust gas, the air-fuel ratio detecting means detecting the oxygen concentration and the exhaust mixture of each cylinder and outputting a signal indicating the average air-fuel ratio for all the cylinders, and the actually detected value of the change of the air-fuel ratio, and learning a first correction value for correcting the detected value of the sucked air flow quantity only by a certain quantity and a second correction value for correcting the fuel supply quantity only at a certain ratio, so that said two correction values are commonly fit for at least two different driving conditions so as to make the air-fuel ratio obtained without said feedback control, substantially equal to the target air-fuel ratio wherein, the fuel supply quantity for a specific cylinder selected from a plurality of cylinders is forcibly corrected at a predetermined rate which is preliminarily set, the state of the air-fuel ratio in the selected specific cylinder is detected by comparing a value of the change of the average air-fuel ratio which is expected to be obtained by the fuel supply quantity correction with a value of the change of the average air-fuel ratio detected by an oxygen sensor, the correction quantity for each cylinder being independently set based on the comparison result, said first and second correction values being those used in common for each cylinder.

2. A learning-correcting method in a fuel control system of an internal combustion engine according to claim 1, wherein the correction value for each cylinder comprises a correction item for correcting the fuel supply quantity only at a certain rate and a correction item for correcting the fuel supply quantity only by a certain quantity.

3. A self-diagnosis method in a fuel supply control system of an internal combustion engine, which comprises performing the self-diagnosis of the fuel supply control system by comparing the correction value for each cylinder, the first correction value and the second correction value, which are set according to the learning-correcting method as set forth in claim 1, with predetermined allowable values corresponding to said correction values, respectively.

4. A self-diagnosis method in a fuel supply control system of an internal combustion engine according to claim 3, wherein when the first correction value exceeds the predetermined allowable value, leakage of air in the suction system of the engine is judged and when the correction value for each cylinder exceeds the predetermined allowable value, a disorder of the fuel supply means of the corresponding cylinder is judged.

5. A learning-correcting apparatus in a fuel supply control system of an internal combustion engine, which comprises:

sucked air flow quantity-detecting means for detecting a flow quantity of air sucked in the engine, basic fuel supply quantity-setting means for setting a basic fuel supply quantity based on the sucked air flow quantity detected by the sucked air flow quantity-detecting means, air-fuel ratio-detecting means for detecting the air-fuel ratio of an air-fuel mixture sucked in the engine, the air-fuel ratio detecting means being an oxygen sensor for detecting oxygen concentration in the exhaust gas, the air-fuel ratio detecting means detecting the oxygen concentration and the exhaust mixture of each cylinder and outputting a signal indicating the average air-fuel ratio for all the cylinders, feedback correction coefficient-setting means for setting a feedback correction coefficient for correcting the basic fuel supply quantity to bring the air-fuel ratio detected by the air-fuel ratio-detecting means close to a target air-fuel ratio, learning correction coefficient-setting means for respective driving conditions, disposed for setting learning correction coefficients for respective driving conditions by learning a deviation of the feedback correction coefficient from a standard value for each driving condition and setting the learning correction coefficient for each driving condition in a deviation-decreasing direction, supply characteristic learning and setting means for respective cylinders, disposed for forcibly correcting fuel supply quantities for respective cylinders by fuel supply means arranged for respective cylinders and learning and setting a correction value for each cylinder based on the difference between an expected value of the change of the air-fuel ratio and the detected change of the air-fuel ratio, wherein, the fuel supply quantity for a specific cylinder selected from a plurality of cylinders is forcibly corrected at a predetermined rate which is preliminarily set, the state of the air-fuel ratio in the selected specific cylinder is detected by comparing a value of the change of the average air-fuel ratio which is expected to be obtained by the fuel supply quantity correction with a value of the change of the average air-fuel ratio detected by an oxygen sensor, the correction quantity for each cylinder being independently set based on the comparison result, said first and second correction values being those used in common for each cylinder, common correction value learning and setting means for learning and setting a first correction value for correcting the sucked air flow quantity detected by the sucked air flow quantity detecting means only by a predetermined quantity and a second correction value for correcting the basic fuel supply quantity only at a constant ratio, so that the first and second correction values are commonly fit for at least two different driving conditions to make the fuel supply quantity set without using the feedback correction coefficient, equal to the quantity corresponding to the target air-fuel ratio, fuel supply quantity-setting means for setting the fuel supply quantities for respective cylinders based on the basic fuel injection quantity, the feedback correction coefficient, the learning correction coefficients for respective driving conditions, the correction values for respective cylinders, the first correction value and the second correction value, set by said respective means, and fuel supply-controlling means for driving and controlling fuel supply means disposed for respective cylinders based on the fuel supply quantities for respective cylinders set by the fuel supply quantity-setting means.

6. A learning-correcting apparatus in a fuel supply control system of an internal combustion engine according to claim 5, wherein the correction value for each cylinder comprises a correction item for correcting the fuel supply quantity only at a certain ratio and a correction item for correcting the fuel supply quantity only by a certain quantity.

7. A self-diagnosis apparatus in a fuel supply control system of an internal combustion engine, which comprises self-diagnosis means for performing the self-diagnosis of the fuel supply control system by comparing the correctin value for each cylinder, the first correction value and the second correction value, which are set by the learning-correcting apparatus as set forth in claim 5, with predetermined allowable values.

8. A self-diagnosis apparatus in a fuel supply control system of an internal combustion engine according to claim 7, wherein when the first correction value exceeds the predetermined allowable value, leakage of air in the suction system of the engine is judged and when the correction value for each cylinder exceeds the predetermined allowable value, a disorder of the fuel supply means of the corresponding cylinder is judged.

* * * * *